US009139256B2

(12) United States Patent
Balfour

(10) Patent No.: US 9,139,256 B2
(45) Date of Patent: Sep. 22, 2015

(54) IMPROVEMENTS RELATING TO MASTS

(75) Inventor: Stuart Balfour, Lunnister (GB)

(73) Assignee: Sail Line Fish Ltd, Sullom, Shetland (GB)

( * ) Notice: Subject to any disclaimer, the term of this patent is extended or adjusted under 35 U.S.C. 154(b) by 0 days.

(21) Appl. No.: 14/000,592

(22) PCT Filed: Oct. 10, 2011

(86) PCT No.: PCT/GB2011/001463

§ 371 (c)(1),
(2), (4) Date: Aug. 20, 2013

(87) PCT Pub. No.: WO2012/114057

PCT Pub. Date: Aug. 30, 2012

(65) Prior Publication Data

US 2013/0319311 A1 Dec. 5, 2013

(30) Foreign Application Priority Data

Feb. 25, 2011 (GB) ..... 1103266.1
Jun. 6, 2011 (GB) ..... 1109443.0

(51) Int. Cl.
*B63B 15/00* (2006.01)
*B63H 9/10* (2006.01)

(52) U.S. Cl.
CPC ..... *B63B 15/0083* (2013.01); *B63B 2015/0058* (2013.01); *B63B 2015/0075* (2013.01)

(58) Field of Classification Search
CPC B63B 15/00; B63B 15/0083; B63B 2015/00; B63B 2015/0016; B63B 2015/005; B63B 2015/0058; B63B 2015/0075; B63B 2015/0083
USPC ..... 114/89–100
See application file for complete search history.

(56) References Cited

U.S. PATENT DOCUMENTS 282,592 A 8/1883 Walthour
3,099,976 A * 8/1963 Schwaneke et al. ..... 114/91

(Continued)

FOREIGN PATENT DOCUMENTS

DE 9104627 6/1991
DE 19835078 4/2000

(Continued)

OTHER PUBLICATIONS

Historic Photo of Boat, Museum of Shetland Photo Archives, http://photos.shetland-museum.org.uk/index.php?a=advanced&s=item&key=XYToxOntzOjEyiJQSE9UT19OVU1CRVliO3M6Nzoi-U00wMDlzOCl7fQ==&pg=1, 1923.

(Continued)

*Primary Examiner* — Daniel V Venne
(74) *Attorney, Agent, or Firm* — Knobbe Martens Olson & Bear LLP

(57) ABSTRACT

The invention relates to improvements to masts and in particular a mast apparatus (17) for raising and/or lowering a mast (18) on a vessel such as a vessel, and a vessel incorporating such a mast apparatus. In one example embodiment, the mast apparatus for raising and/or lowering the mast on a vessel comprises a mast; a mast housing (28); a pivot (44) for the mast fixedly connected to the mast housing; a lateral movement control mechanism (34) for enabling controllable lateral movement of the mast with respect to the pivot and the mast housing; a lateral movement control mechanism such as hydraulic ram (30) connected to the mast and connected to the mast housing, or connected to the mast and connectable to a vessel, for driving the mast to rotate about the pivot and move laterally under the control of the lateral movement control mechanism so as to raise or lower the mast and move the mast laterally in a controlled manner.

25 Claims, 18 Drawing Sheets

(56) References Cited

U.S. PATENT DOCUMENTS

| | | | | | |
|---|---|---|---|---|---|
| 3,507,240 | A | * | 4/1970 | Butler | 114/39.32 |
| 3,827,386 | A | | 8/1974 | Faden | |
| 4,112,861 | A | | 9/1978 | Lewis | |
| 4,121,530 | A | | 10/1978 | Arce | |
| 4,259,917 | A | | 4/1981 | Frank | |
| 4,453,482 | A | | 6/1984 | Barker | |
| 4,584,957 | A | * | 4/1986 | Belvedere | 114/39.28 |
| 4,610,212 | A | * | 9/1986 | Petrovich | 114/39.26 |
| 4,655,154 | A | | 4/1987 | Leonard | |
| 4,718,370 | A | | 1/1988 | Portell-Vila | |
| 4,940,008 | A | | 7/1990 | Hoyt | |
| 5,044,410 | A | * | 9/1991 | Mix | 114/90 |
| 5,243,927 | A | | 9/1993 | Messick | |
| 5,570,651 | A | | 11/1996 | Schiff | |
| 5,865,136 | A | | 2/1999 | Alexander | |
| 6,000,354 | A | * | 12/1999 | Vanlerberghe | 114/90 |
| 6,923,131 | B2 | * | 8/2005 | Petrovich | 114/39.26 |
| 6,990,916 | B1 | | 1/2006 | Atwood, Jr. | |
| 7,137,346 | B1 | | 11/2006 | Francke | |
| 7,418,911 | B2 | | 9/2008 | McClintock | |
| 7,614,356 | B2 | | 11/2009 | Knisely et al. | |
| 2002/0139284 | A1 | | 10/2002 | Iacoboni | |
| 2008/0035042 | A1 | | 2/2008 | Smith | |
| 2010/0065104 | A1 | | 3/2010 | Baruh | |

FOREIGN PATENT DOCUMENTS

| | | |
|---|---|---|
| DE | 10205723 | 9/2002 |
| DE | 202004004431 | 5/2004 |
| DE | 102006009206 | 8/2007 |
| EP | 2031155 | 3/2009 |
| FR | 2535671 | 5/1984 |
| GB | 191511143 | 7/1916 |
| NL | 9302119 | 7/1995 |
| SU | 125503 | 11/1959 |
| SU | 1152870 | 4/1985 |
| WO | WO87/00812 | 2/1987 |
| WO | WO95/24334 | 9/1995 |

OTHER PUBLICATIONS

Photos of boat and sail, accessed Nov. 26, 2010.
Halcrow, The Sail Fishermen of Shetland, 1950.
Nicolson, The Swan, Shetland's Legacy of Sail, 1999.

* cited by examiner

IMPROVEMENTS RELATING TO MASTS

FIELD OF THE INVENTION

The invention relates to a mast apparatus for raising and/or lowering a mast on a vessel such as a vessel, and a vessel incorporating such a mast apparatus.

BACKGROUND

Historically, sail has been used by fishing vessels but this has been superseded by the use of engines over many years. Commercial fishing vessels typically rely on engines to get to and from fishing grounds and to conduct fishing. Use of sail in combination with engines on vessels is typically restricted to leisure sailing vessels rather than commercial fishing vessels. Leisure sail systems are numerous and are often used in combination with engines on leisure vessels. Nevertheless, such systems typically lack the robustness and ease of use required on a commercial fishing vessel.

Adaptations to vessels to allow for fishing, use of engines and/or sail power whilst fishing and use of engines and/or sail power to get to and from fishing grounds can be problematic. Using wind for propulsion, particularly to get to and from fishing grounds, is desirable as it utilises a renewable energy source and reduces the overall carbon emissions from fishing vessels.

For example, sail systems need to be identified that can be broken out reefed and stowed easily and safely. Further, this must be carried out by a crew whose number is dictated by the needs of commercial fishing not by the requirements of rigging the sail(s). In addition, the mast and, if necessary rigging, needs to be mounted and demounted quickly and placed out of the way of the crew when fishing. Indeed, if it is intended to fully integrate the propulsion systems of engine and sail then the goal would be to continue to fish successfully switching from sail power to engine and back again as wind conditions and the working situation dictate.

For example, it may be desirable to have a shorter mast and/or to stow the mast, boom, sail and rigging so as to reduce any leeway their presence introduces to the minimum possible and so provide a more secure working situation when fishing.

It may be desirable to minimise any list introduced by having a sail rig on a commercial fishing vessel arranged so as not to unduly affect the vessel's stability.

It may be desirable for the mast when in a lowered or stowed position to be out of the way of the crew carrying out fishing activities. It may further be desirable for the mast to lie within the periphery of the vessel so as not to extend beyond the periphery of the vessel and thereby get in the way during manoeuvring activities. Further it may be desirable for the mast when upright to be located over a keel of a vessel and/or located over a typical sailing mast location for a vessel (often around ⅓ from the bow of the vessel and ⅔ form aft) and yet be generally centrally or substantially centrally located within the vessel when in a lowered position so as not to unduly affect the centre of gravity and therefore steerability and manoeuvrability of the vessel.

It may also be desirable to minimise the physical space taken up on deck, as this is often limited on fishing vessels. Further it may be desirable not to impact unduly on the provision of a cabin for the crew which is often seen as an essential for fishing in harsh climates.

It may be desirable for the mast when lowered to lie within the length of the vessel e.g. when in port, so as not to obstruct movement of the vessel and reduce the risk of damage to and from other vessels.

Further it may be desirable for the raising or lowering (stepping or un-stepping) of the mast to be effected from within the cabin.

Further it may be desirable if this could be carried out by a single member of crew.

Previously, GB11143 (MCKECHNIE) describes a folding, collapsible, wireless mast having a fixed pivot operated by a hydraulic system.

U.S. Pat. No. 4,655,154 (LEONARD) describes a collapsible mast assembly having a tubular mast support partially open at one side that allows the mast to tilt backwards to a horizontal position. It can then be moved rearwardly or forwardly as desired.

DE102006009206 (HERM SPRENGER) describes a mast laying device with a torsional spring in a hollow mast.

U.S. Pat. No. 4,259,917 (FRANK) describes a foldable mast assembly wherein a main mast is pivotally connected to a stub mast which is pivotally connected to a base secured to the sail boat deck. A removable pin extends between the stub mast and base whereby the main mast and stub mast may be folded to an inoperative position substantially parallel to the main deck and centred approximately lengthwise of the sail boat.

U.S. Pat. No. 6,990,916 (ATWOOD) describes a sail boat mast stepping system in which the mast pivots about a pivot point.

U.S. Pat. No. 4,112,861 (LEWIS) describes a mast stepping and unstepping structure having an upright mast with upper and lower end portions, the lower end pivotally connected to the hull.

DE19835078 (TEPPNER) describes two interlocking spars on a sliding deck mounting.

W095/24334 (LOVELADY) describes a slider assembly for lowering and raising a mast.

W087/00812 (CHRISTENSEN) describes a sail boat having a pivotally mounted mast.

FR2535671 (NAUD) describes a mast on a shaft held by two rigid legs and fixed at one end by a ball and socket joint and at the other to a piece which slides on a rail which makes it possible, in a translational movement of the piece, to lower or raise the mast.

US2008/0035042 (SMITH) describes a system for lifting and lowering a sail boat mast.

U.S. Pat. No. 282,592 (WALTHOUR) describes a device for unshipping masts having a swinging truss.

U.S. Pat. No. 3,827,386 (FADEN) describes a means for lowering the mast on a sail boat in which the lower end of the mast is pivotally and slidably secured to the hull of the sail boat.

Other documents include U.S. Pat. No. 5,243,927 (MESSICK), U.S. Pat. No. 5,865,136 (ALEXANDER), US20020139284 (IACOBONI), U.S. Pat. No. 4,718,370 (PORTEL_VILA), U.S. Pat. No. 4,940,008 (HOYT), U.S. Pat. No. 4,121,530 (ARCE), U.S. Pat. No. 7,418,911 (McCLINTOCK), U.S. Pat. No. 7,137,346 (FRANCKE), U.S. Pat. No. 5,570,651 (SCHIFF), U.S. Pat. No. 7,614,536 (KNISELY), U.S. Pat. No. 4,112,861 (LEWIS), U.S. Pat. No. 4,453,482 (BARKER) and NL9302119.

None of the above documents provide an easily operated mast apparatus suitable for raising and/or lowering a mast and for incorporating into a vessel having an engine and sail.

The above documents describe systems that are over complex to use involving several steps for raising and/or lowering a mast, necessitating the crew moving about the vessel to do so. Further many of the systems described above leave a mast protruding beyond the vessel. Further, the mast when lowered may affect the vessel's centre of gravity and therefore stability and/or manoeuvrability. Some describe outlying rigging that would impede movement of crew on a vessel and necessitate detachment by crew whilst on deck.

Further, in some of the above documents, the mast foot is located in a fixed or fixed but pivotable position on deck.

None of the documents provide a solution suitable for use in a commercial fishing vessel. Further problems remaining include being too flimsy; requiring multi-handed operation; requiring operation from outside the cabin; requiring stabilising lateral stays or lateral supports during use and/or during raising and lowering of the mast; the mast extending outside the vessel when the mast is in a lowered position; de-stabilising the vessel once the mast is lowered because the mast extends over the rear of the vessel; supporting the weight of the mast on a pivot so that it is hard to manoeuvre the mast on the pivot and the pivot is subject to excessive wear and tear; requiring the provision of winch and/or rope pulley or other manual mechanisms for raising and lowering the mast.

The present invention seeks to alleviate one or more of the above problems.

STATEMENTS OF INVENTION

In one aspect the present invention provides a mast apparatus for raising and/or lowering the mast on a vessel comprising: a mast housing; a pivot for a mast; a lateral movement control mechanism for enabling controllable lateral movement of a mast with respect to the pivot and the mast housing; a drive member connectable to a mast and connected to the mast housing, or connectable to a mast and connectable to a vessel, for driving a mast to rotate about the pivot and to move laterally under the control of the lateral movement control mechanism so as to raise and/or lower a mast in a controlled manner.

In an example embodiment, the pivot may be fixedly connected to the mast housing.

In an example embodiment, the apparatus may comprise a mast.

The drive member may be rigid. In an example embodiment, the drive member comprises one or more of a ram, a hydraulic ram, a hydraulic, multistage, telescopic ram, a pushrod, a rope, a wire rope. For example, a small hand driven, or powered, winch could be used with suitably positioned blocks and pivots, and wire rope as a connector to the mast, to raise and lower the mast.

In an example embodiment the drive member is power driven and/or manually driven.

In an example embodiment the pivot is an offset pivot.

In an example embodiment the offset pivot is offset from a centreline of a longitudinal axis of a mast or offset from a centreline of a longitudinal axis of an intended position for a mast.

In an example embodiment, the lateral movement control mechanism may comprise a pivoting collar for a mast and the pivoting collar comprises the pivot.

In an example embodiment, the pivoting collar may comprise an inner bearing having an inner bearing surface for allowing lateral movement of a mast with respect to the pivoting collar. The inner bearing may comprise nylon or PTFE.

In an example embodiment the pivoting collar comprises an outer collar for supporting a mast.

In an example embodiment the outer collar surrounds an inner bearing having an inner bearing surface for allowing lateral movement of a mast with respect to the pivoting collar.

In an example embodiment the pivoting collar comprises a pivoting through-bore forming the pivot and/or a pivot pin forming the pivot.

In an example embodiment the pivoting collar comprises a plate extending in one or more directions.

In an example embodiment the pivoting collar comprises an outer collar for supporting a mast and the plate substantially surrounds the outer collar.

In an example embodiment the pivoting collar comprises an offset pivot.

In an example embodiment in which the offset pivot is at a fixed distance offset from a centreline of a longitudinal axis through the pivoting collar or at a fixed distance offset from a centreline of a longitudinal axis of a mast or at a fixed distance offset from a centreline of a longitudinal axis of an intended position for a mast.

In an example embodiment pivoting collar comprises an offset pivoting through-bore forming the pivot and/or an offset pivot pin forming the pivot.

In an example embodiment, the pivoting collar may comprise two opposing spigots, such as outwardly extending opposed spigots, forming the pivot.

In an example embodiment, the lateral movement control mechanism may comprise one or more guideways for guiding the lateral and/or rotational movement of a mast with respect to the pivot.

In an example embodiment, a lateral movement control mechanism comprising a lower guideway may be provided for guiding and supporting a lower portion of a mast.

In an example embodiment, a lateral movement control mechanism comprising an upper guideway may be provided for guiding a lower portion of a mast.

In an example embodiment, a guide wheel may be provided on a mast for engaging with the mast lower guideway and/or the mast upper guideway.

In an example embodiment, one or more guideways may define a path of travel of predetermined shape and/or length for a portion of the mast.

In an example embodiment, one or more guideways may be curved for guiding rotational and lateral movement of the mast. This may be an elliptical or other shaped curve to provide rotational and lateral motion of the mast. In an example embodiment, one or more guideways may be parabolic in shape for guiding parabolic movement of the mast.

In an example embodiment, the apparatus may comprise co-operating upper and lower guideways for engaging with a guide wheel on the mast.

In an example embodiment, one or more guideways may each comprise a pair of opposing guide rails.

In an example embodiment, one or more guideways may comprise at least one flat bar guide rail having at least one flat side in cross section, such as a square or rectangular cross section.

In an example embodiment, the lateral movement control mechanism may comprise a resilient member.

In an example embodiment, the resilient member may comprise at least one of: a spring under compression; a spring under extension; an elastomeric member under compression; and an elastomeric member under extension; a resilient member; a resilient member using hydraulic oil, or air or vacuum, such as a gas spring. Thus, mechanical (such as but not limited to spiral wound springs) springs or oil/gas/vacuum springs may be used.

In an example embodiment, the mast housing may be arranged so that the pivot is at an upper portion of the mast housing so that when a mast is pivoted into the lowered position, the mast is situated at an upper portion of the mast housing.

In an example embodiment, a vessel having a deck may be provided and the mast housing is arranged so that the pivot is above deck.

In an example embodiment, the vessel may have a cabin and the mast housing is located forward of and/or on the cabin and/or at least one crutch for the mast is provided on the roof of the cabin.

In an example embodiment, the mast housing may comprise a pair of substantially parallel walls for mounting one or more guide rails thereto to form one or more guideways for guiding the rotation and/or lateral movement of the mast.

In an example embodiment, the drive member, such as the hydraulic ram, may be arranged to push a lower portion of the mast away to lower the mast during rotation of the mast about the pivot.

In an example embodiment, the apparatus may comprise a mast and a guideway is provided in the mast.

In an example embodiment, the mast guideway comprises a pivot trackway in the mast for the pivot to be guided there along.

In an example embodiment, the pivot trackway may comprise a pair of corresponding opposing slots in a hollow mast for the pivot to be guided there along.

In an example embodiment, a vessel may be provided and the lateral movement of the mast, the mast length and the vessel length are selected so that the mast lies within the length of the vessel when in a lowered and/or stowed position.

In an example embodiment, a vessel may be provided and the position of the mast when raised in an erect position is over a keel of the vessel.

In an example embodiment, a mast housing keel support fixed above the keel may be provided beneath the mast housing.

In an example embodiment, the apparatus may comprise a releasable locking mechanism for locking the mast heel into the mast housing when the mast is upright.

In an example embodiment, a stop may be provided at an end of a guideway.

In an example embodiment, the mast apparatus for raising and/or lowering the mast on a vessel may comprise: a mast; a mast housing; a pivot for the mast fixedly connected to the mast housing; a lateral movement control mechanism for enabling controllable lateral movement of the mast with respect to the pivot and the mast housing; a hydraulic ram connected to the mast and connected to the mast housing, or connected to the mast and connectable to a vessel, for driving the mast to rotate about the pivot and move laterally under the control of the lateral movement control mechanism so as to raise and/or lower the mast in a controlled manner. The hydraulic ram may be pivotally connected to the mast and pivotally connected to the mast housing or vessel.

In a further aspect the invention provides a vessel comprising a mast apparatus as described in any of the example embodiments herein.

In a further aspect there is provided a method of raising and/or lowering a mast comprising providing an apparatus as described herein and driving the drive member to rotate a mast about the pivot and to move a mast laterally under the control of the lateral movement control mechanism so as to raise or lower a mast in a controlled manner.

BRIEF DESCRIPTION OF THE INVENTION

The invention will now be described in more detail, by way of example only, with reference to the following Figures in which like numerals refer to like features.

FIG. 1 also shows a close up side elevation of a web lashing arrangement according to an example embodiment of the invention.

DETAILED DESCRIPTION OF THE INVENTION

Figure 1:
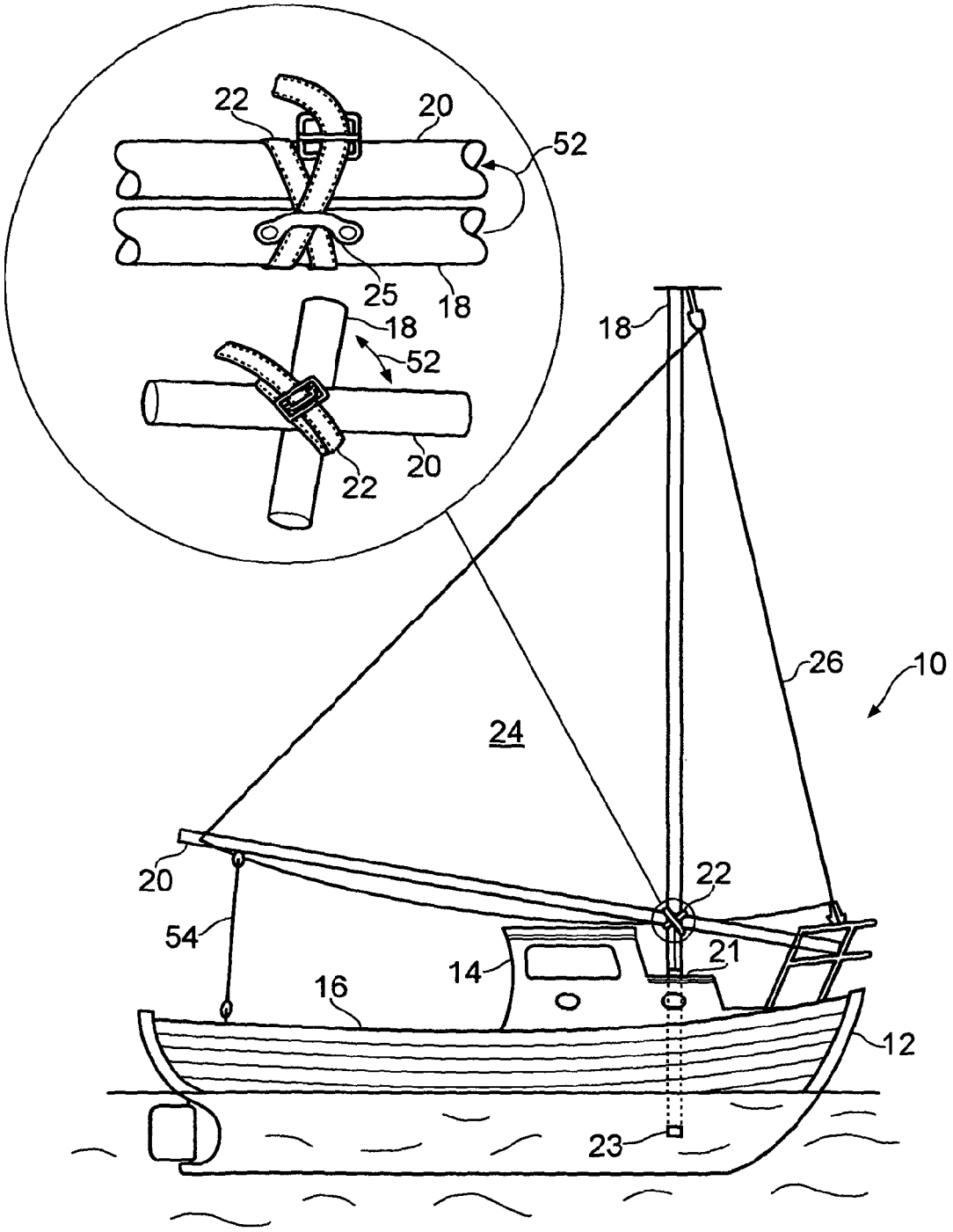
FIG. 1 shows a side elevation view of a commercial fishing vessel and a sailing rig suitable for use in a mast apparatus, or a vessel incorporating a mast apparatus, according to the present invention.

FIG. 1 shows a side elevation view of a vessel 10 having a sailing rig suitable for a commercial fishing vessel powered by engine and sail incorporating a mast apparatus according to the invention (not shown). The mast apparatus of the invention will be described with respect to the remaining figures. Vessel 10 has a hull 12, a cabin 14 and a deck 16. The sailing rig comprises a mast 18, a boom 20, a lashing 22 (which may be a rope or web lashing or other suitable fixing), a sail 24 and a forestay 26. Here, mast 18 is free-standing and rotatable within a nylon bearing 21 and stepped on a nylon bearing 23 above the keel. Later it will be seen that in example embodiments of the present invention, the mast will be free-standing but typically not rotatable about its longitudinal axis because of the use of a pivot to allow the mast to rotate about a point along its length and so be raised upright and/or lowered. The boom 20 is lashed to mast 18 by lashing 22 or other suitable fixing. The boom can easily be rotated about the mast to allow the setting of the sail on the other side of the vessel. The sail 24 is a single large jib which can be roller reefed to the forestay 26. The sail 24 is fast at the fore end of boom 20 and a sail sheet 54 is used aft to tension sail 24.

In this embodiment there is no rigging either side of mast 18 so mast 18 is clear to carry sail 24 on either side of mast 18. Boom 20 may remain fixed to the mast 18 and fore of the vessel to allow sail 24 a fastening point forward and aft. The roller reef system around forestay 26 enables the amount of sail 24 to be increased or decreased as required.

Fishing typically takes place from the rear of the vessel behind the cabin 14. The sail 24 and boom 20 may be mounted so that there is sufficient head height for someone to work on deck 16 aft of cabin 14. Here mast 18 is mounted on a front portion of cabin 14.

This sailing rig and vessel are suitable for use with the present invention and the mast apparatus of the present invention will now be described in more detail by way of example with reference to the remaining Figures.

Figure 2:
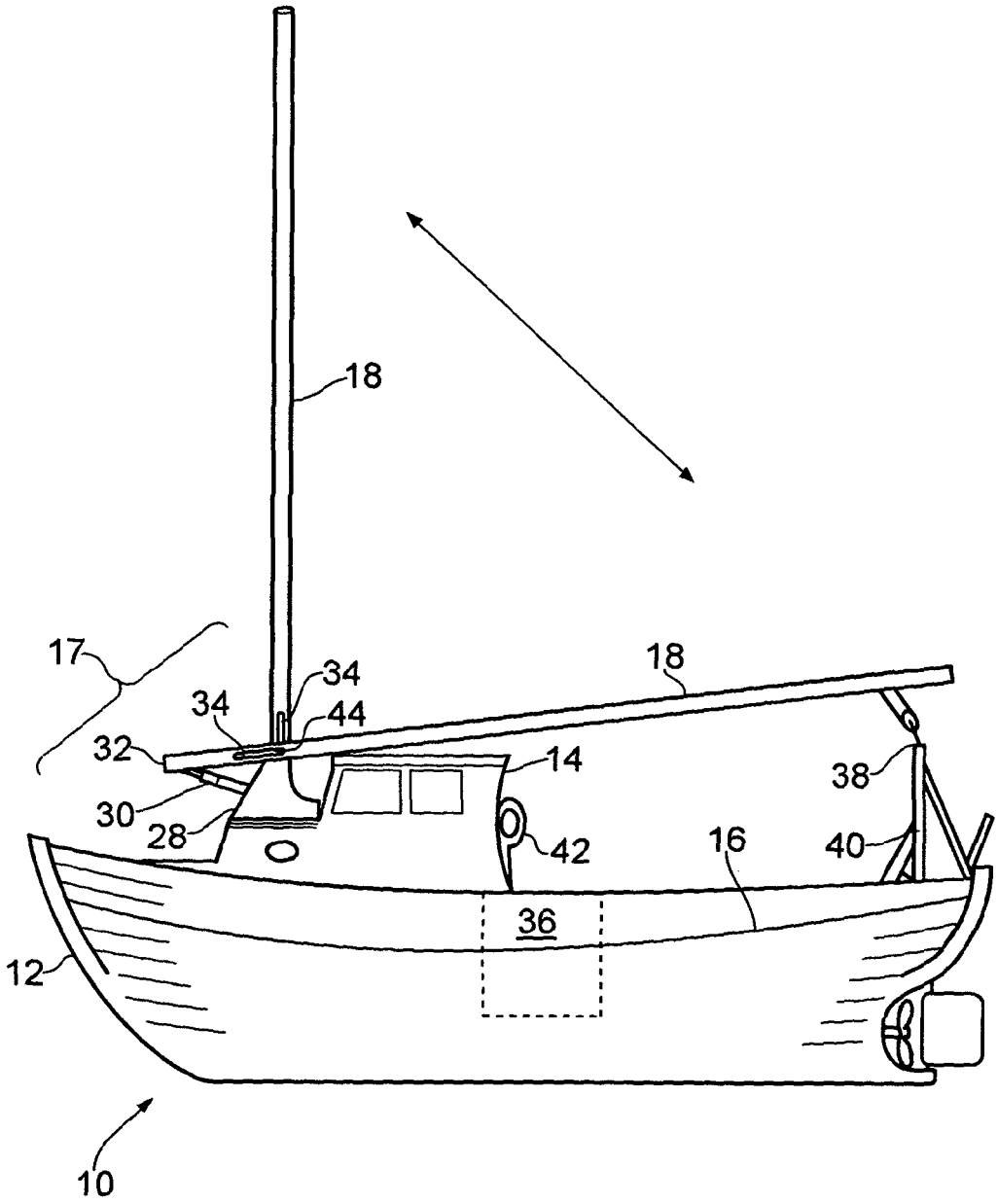
FIG. 2 shows a vessel similar to that of FIG. 1 incorporating a mast apparatus according to one example embodiment of the present invention with boom and sail optionally stowed and mast in upright and lowered positions.

FIG. 2 shows vessel 10, with hull 12, cabin 14, deck 16 and mast apparatus 17 here comprising a mast housing 28 having a pivot 44 and optionally a mast 18, seen here in raised and lowered positions. The mast apparatus 17 is typically arranged so that the mast 18, does not rotate about its longitudinal axis (along the length of the mast) when it is in the mast housing 28. Here, pivot 44 passes through a pivot trackway 34 in the mast and so prevents rotation of the mast 18 about its longitudinal axis. Some components of the sailing rig have been removed prior to lowering the mast. Thus no boom 20, sail 24 or forestay 26 are seen. It can be envisaged that the mast can be raised and lowered with these components in place. For example, the sail could be rolled around the forestay and the boom 20 simply unlashed from mast 18 before lowering the mast. In one example, the mast has two flat eyes 25 (one of which is seen in the close up elevation view of lashing 22 in FIG. 1, the eyes 25 having roughly rectangular cross section and being on opposing sides of mast 18 for mounting lashing 22 in the eyes to hold the boom 20 in position along the length of mast 18. The eyes 25 and lashing 22 hold the boom vertically in position on the mast (for example, when the mast 18 is upright) but allow the boom 20 to rotate on the mast. Firstly, the boom 20 can rotate from one side of the mast 18 to the other, about the mast's longitudinal axis, to allow sailing on different tacks, and, secondly, the boom 20 can rotate about the lashing 22 so that the boom is either at roughly about 90 degrees to the mast (in a sailing position) or lies roughly parallel with the mast 18 (in a stowed position) as shown in the close ups in FIG. 1). Thus, as will be described in more detail later, in this example embodiment, the boom is lashed to the mast 18 in such a way that the boom follows the mast as the mast is lowered and rotates about the mast so as to lie generally parallel with it, perhaps also in cradle 68 (seem in FIG. 6). Similarly as the mast 18 is raised the boom may rotate from a position parallel to the mast 18 to a sailing position when it is roughly at 90 degrees to the mast 18. Thus, the boom 20 need not be unlashed from mast 18 before lowering mast 18.

Indeed, in one embodiment a tape lashing is used to lash the boom on one side of the mast so that when the mast is lowered the boom is able to rotate with respect to the mast and lay alongside the mast, optionally in cradles 68. Typically the forestay with the sail furled around it, is slackened from aft before the mast is lowered. In one example embodiment, the boom 20 (seen in FIG. 1) is lashed, for example loosely, to one side of the mast, part way along the length of the boom 20 so that it extends both forward and aft of the mast when the mast is upright (unlike typical arrangements on pleasure yachts which have an end of the boom attached to the mast). Nevertheless, the boom 20 can rotate between about 80-90 degrees on either side of the mast to allow for sailing on either tack. The forestay 26 typically has a swivel at its upper end at or near the top of the mast and a furling mechanism at its lower end. In order to tack, the sail 24 is furled around the forestay 26, and the aft of the sail goes in front of the mast and the sail is then unfurled on the other side of the mast. This furling is very controllable and can be done by hand winch or electric power or hydraulic power.

Figure 11:
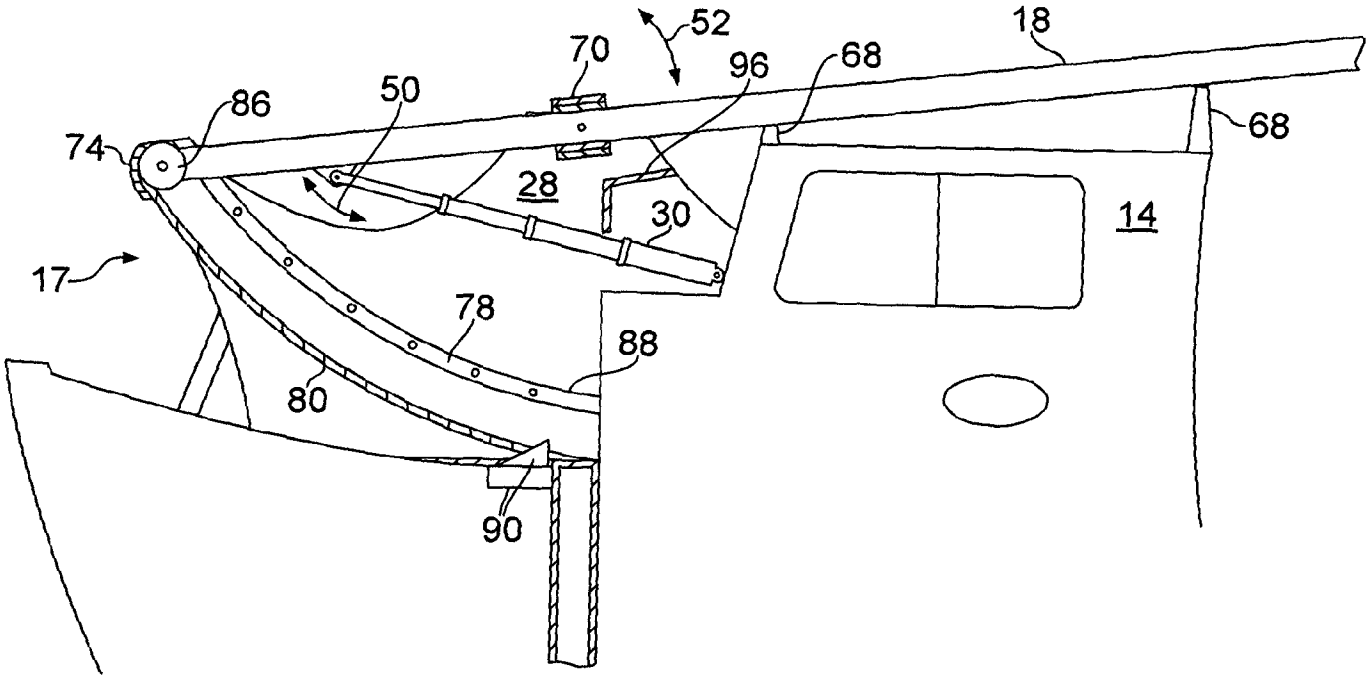

FIG. 2 also shows an upstanding mast housing 28 positioned on a front portion of cabin 14. Thus, mast housing 28 is positioned at some distance above deck 16. A hydraulic ram 30 is connected between the mast heel 32 of mast 18 and mast housing 28 (or between mast heel 32 and cabin 14 as seen in FIG. 11). Mast 18 is provided with a lateral movement control mechanism in the form of a pivot trackway 34 for controlling lateral movement of the mast during the raising and/or lowering of the mast. In this example embodiment, pivot trackway 34 comprises two opposing slots in mast 18. Further, mast 18 is hollow in this example embodiment. Mast 18 is typically aluminium or carbon fibre with a diameter around 60-100 mm or around 80 mm but may be stainless steel, other fibre composite or other suitable material. Pivot trackway 34 is provided to allow pivot 44 (seen in FIG. 3) mounted on mast housing 28 to travel along the slots in the mast forming the trackway. Other examples of lateral movement control mechanism can be envisaged, for example, here the trackway is straight, it may be curved. Alternatively, the pivot and lateral movement control mechanism may comprise pivoting spigots on opposing sides of the mast for travel in a trackway provided on the mast housing.

Ram 30 may be a multi stage ram and in this example embodiment is a hydraulic ram connected to a hydraulic system typically found on commercial fishing vessels powered by diesel engine 36. Other drive sources such as electric power or manual power may be used may be used. Similarly, drive members such as one or more rams and/or pushrods and/or ropes and/or lines may be used in alternative embodiments of the invention. Thus, whilst a hydraulically powered mast apparatus 17 is envisaged, a hydraulic and/or manual and/or electric powered mast apparatus is also envisaged. Thus, a main power source and one or more back up power sources may also be provided to mitigate against failure of the main power source.

A sail sheet fastening 38 is provided aft next to a line baiter guard 40 for guarding a line baiter. A line hauler 42 is provided adjacent cabin 14 close to engine 36. Typically the vessel may be a line (rather than net) fishing vessel. The hydraulics system is also typically used to drive the line hauler 42 to raise (and/or lower) the fishing line (or net). Hydraulics may be used elsewhere to open and close hatches and doors on larger vessels.

Figure 3:
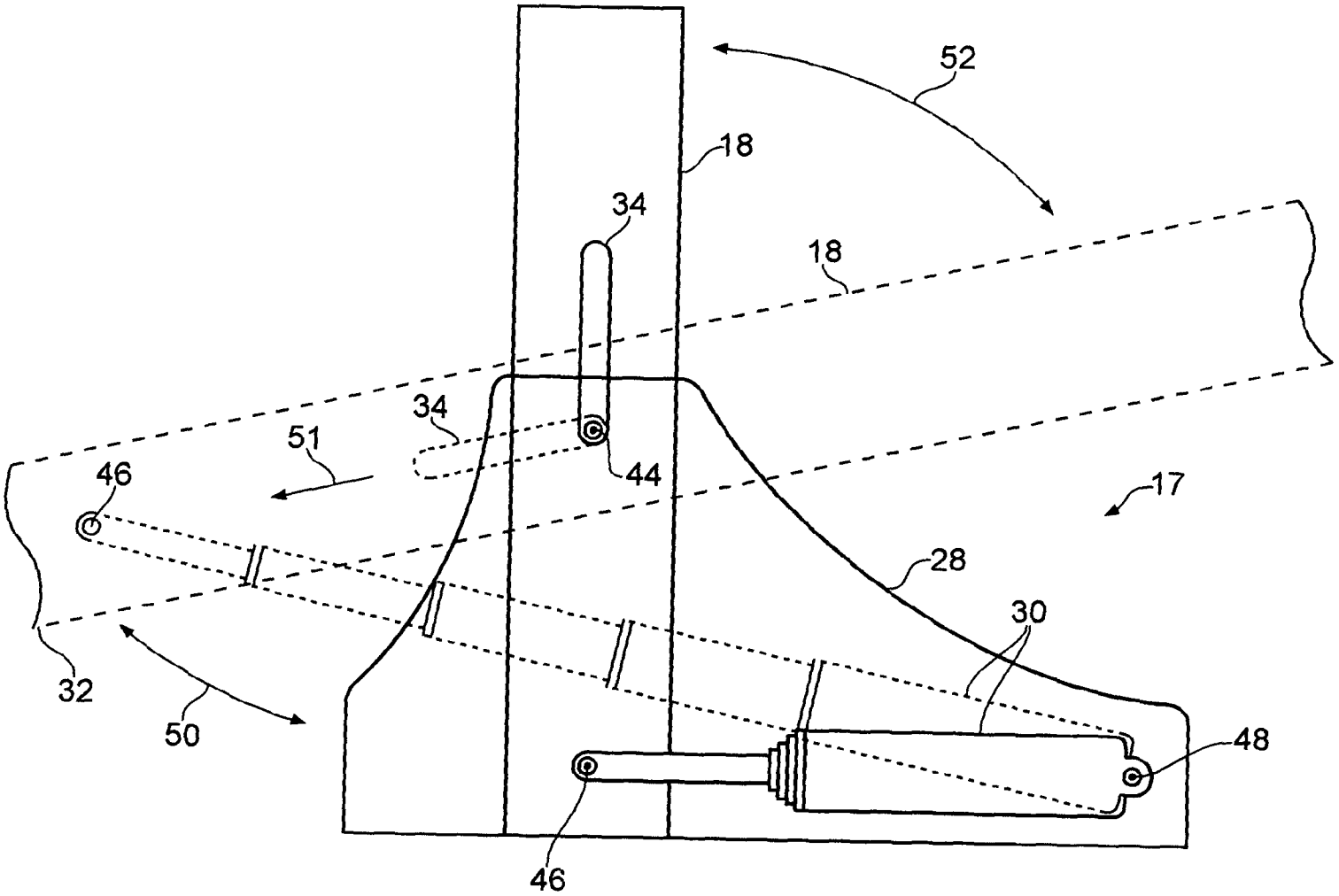
FIG. 3 shows a close-up side elevation view of the mast apparatus, for raising and/or lowering a mast, of FIG. 2.

FIG. 3 shows a close-up of the mast raising and/or lowering apparatus of FIG. 2. The dotted lines show the apparatus with the mast in a lowered position.

Mast housing 28 is typically formed from two substantially parallel, spaced, upstanding walls (not shown). Mast housing 28 is provided with a pivot 44 that is, in a preferred example embodiment, located fixedly to an upper portion of mast housing 28. Pivot 44 is mounted on mast housing 28 between the two spaced, upstanding walls. For example, pivot 44 may comprise a rotating cylinder on a fixed, cylindrical cross spar between the two upstanding walls of mast housing 28. Alternatively, pivot 44 may be a fixed cross spar of generally circular cross section between the two upstanding walls of mast housing 28. In either case, it may be advantageous for pivot 44 to have a low friction surface such as smooth stainless steel or aluminium. Pivot 44 passes through mast 18 via pivot trackway 34 in mast 18.

Hydraulic ram 30 is fixed between hydraulic ram pivots 46 on mast 18, at or adjacent a mast heel 32, and hydraulic ram pivots 48 on mast housing 28 (or on cabin 14 or on hull 12, not shown). Bidirectional arrow 50 indicates the push/pull direction of hydraulic ram 30. Bidirectional arrow 52 indicates the mast lower/mast raise directions of mast 18 depending upon the action of hydraulic ram 30 and the action of pivot 44 and pivot trackway 34. Hydraulic ram 30 is optionally a multistage, telescopic, hydraulic ram to provide greater lateral movement of the mast within the vessel upon activation.

Thus, the mast apparatus in this example embodiment is provided with a lateral movement control mechanism for enabling controllable lateral movement of the mast with respect to the pivot in the form of a guideway provided by pivot trackway 34. The guideway, here pivot trackway 34 in mast 18, guides the movement of the mast with respect to pivot 44.

The pivot 44 gives the mast 18 a hinging point which is typically fixed in mast housing 28. The pivot point trackway 34 allows the mast to slide through this hinging point. The foot of the mast will slide out once lowered.

To lower the mast, the multistage, telescopic, hydraulic ram 30, is activated by a switch and an associated hydraulic system (not shown). The multistage telescopic ram 30 extends slowly pushing the mast heel 32 (or a lower portion of the mast) away from the mast housing 44 about pivot 44. Thus, telescopic ram 30 pushes mast heel 32 to the left in the direction of arrow 51 so that mast 18 also travels laterally (typically, for example, forward with respect to hull 12) as the pivot trackway 34 in mast 18 travels laterally over pivot 44 in mast housing 44. In this example, the weight of the mast rests on hydraulic ram 30, hydraulic ram pivots 46, 48, pivot trackway 34 and pivot 44 in mast housing 28. In another embodiment shown in FIGS. 8 to 12 the weight of the mast is supported elsewhere (by provision of a lower guideway 80) removing the effect of the weight of the mast on the operation of the pivot, and to control the movement of the mast heel 32.

Figure 4:
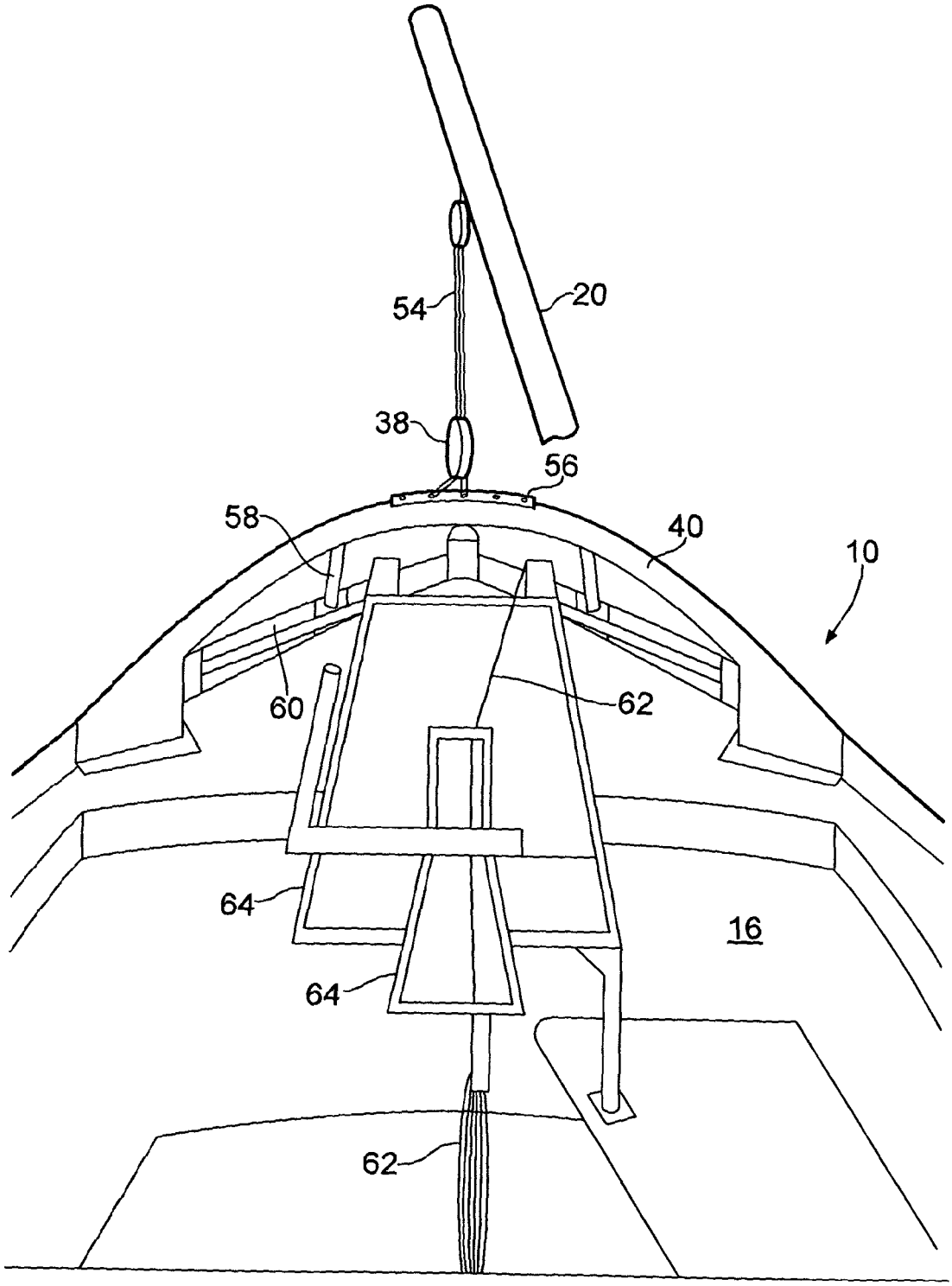
FIG. 4 shows a perspective view of the vessel of FIG. 1 looking towards the rear of the vessel and the positioning of the sail sheet and associated trackway relative to fishing line equipment.

To raise the mast the multistage telescopic hydraulic ram is activated to contract. The hydraulic ram 30 pulls the mast heel 32 (or a lower portion of the mast) towards the mast housing pulling the mast along the pivot 44 via pivot trackway 34 in the direction opposite to arrow 51 and further rotating the mast about pivot 44 in the direction of bidirectional arrow 50. In this way the mast is rotated and moved laterally, in a controllable manner, until it arrives at a vertical position. One possible disadvantage of this embodiment is that the mast has two opposing holes to provide pivoting trackway 34, thus potentially reducing the structural integrity of the mast. Other embodiments proposed and described later either do not have such a pivoting trackway and therefore have greater structural integrity and/or are provided with other stabilising mechanism in the form of a resilient member such as a compression, or extension, spring, or shock absorber FIG. 4 shows an aft view of the vessel 10 showing the deck 16, boom 20, sail sheet fastening 38, line baiter guard 40, sail sheet 54, sail sheet fastening trackway 56, support for line baiter 60, fishing line 62 and line baiter 64. The present invention is particularly suitable for use with fishing vessels that line fish and/or are of around 4-20 m in hull length, or more typically 6-10 m in hull length. The sail sheet fastening trackway 56 is secured above and out of the way of the line baiter and so will not interfere with deployment of the line.

Figure 5:
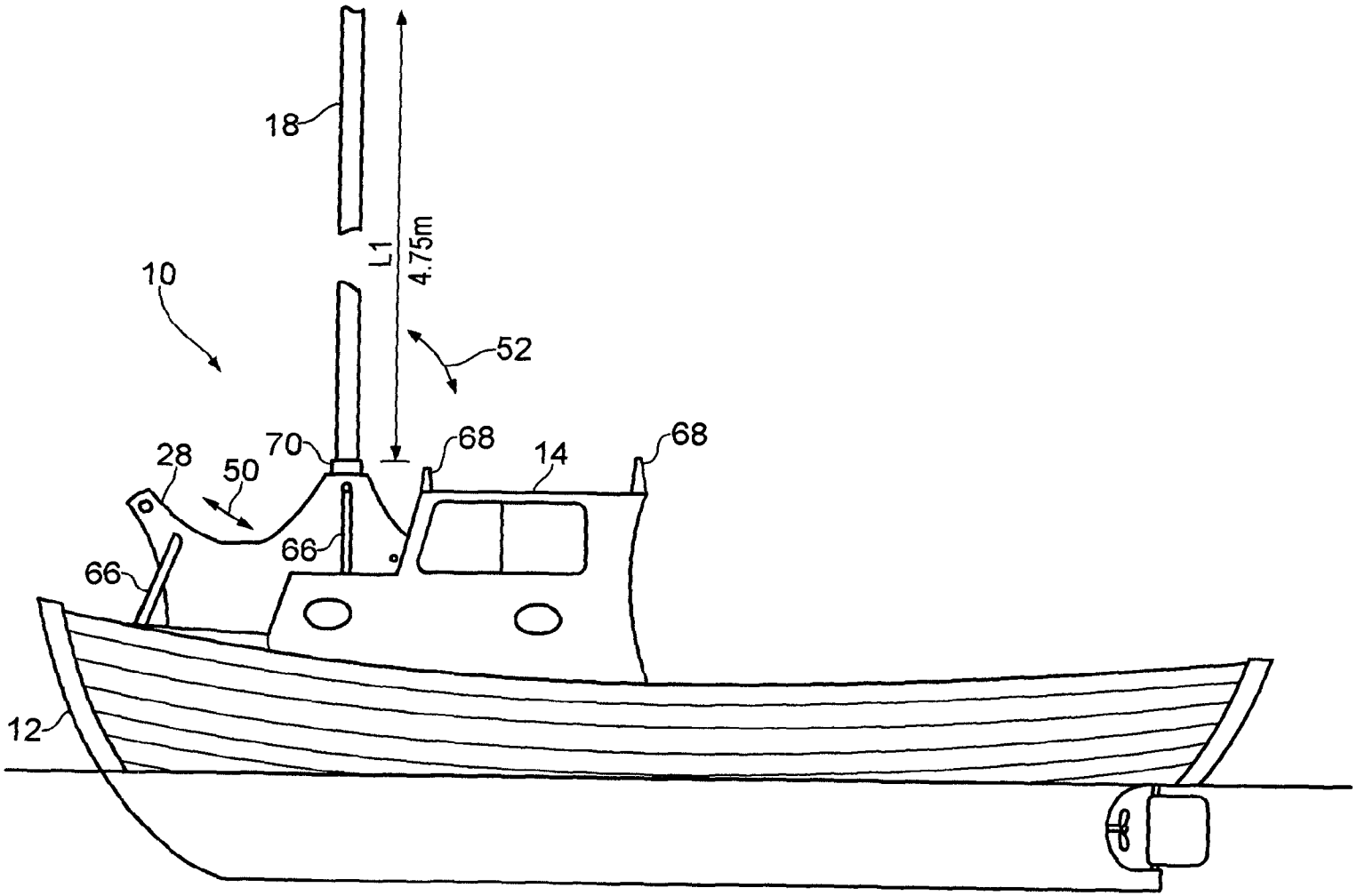
FIG. 5 shows a side, elevation view of a commercial fishing vessel adapted for sail use according to a further example embodiment of the invention, the mast being in an upright position.
Figure 6:
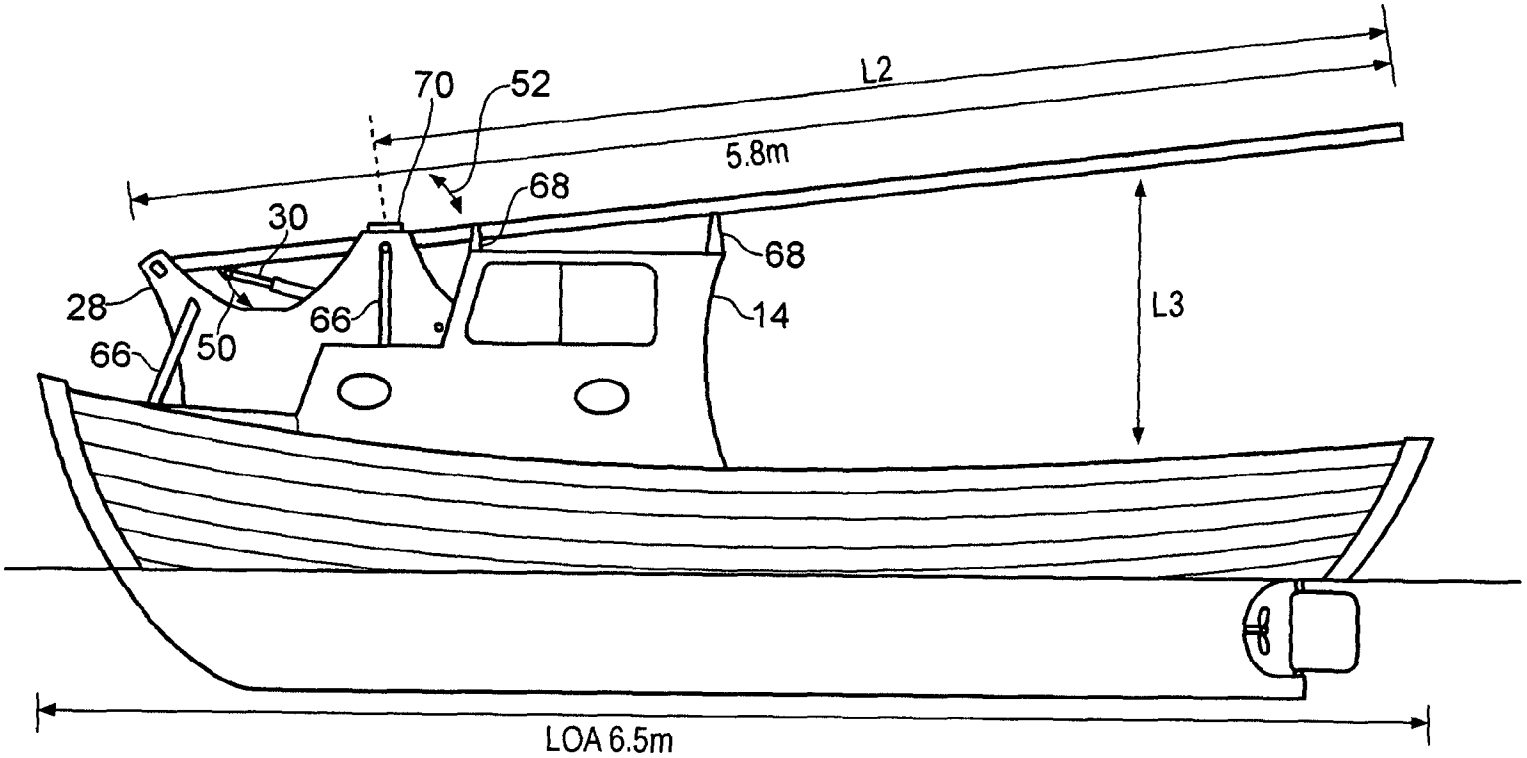
FIG. 6 shows the vessel of FIG. 5 with the mast in a lowered position and further stowed in crutches on the cabin roof.
Figure 7:
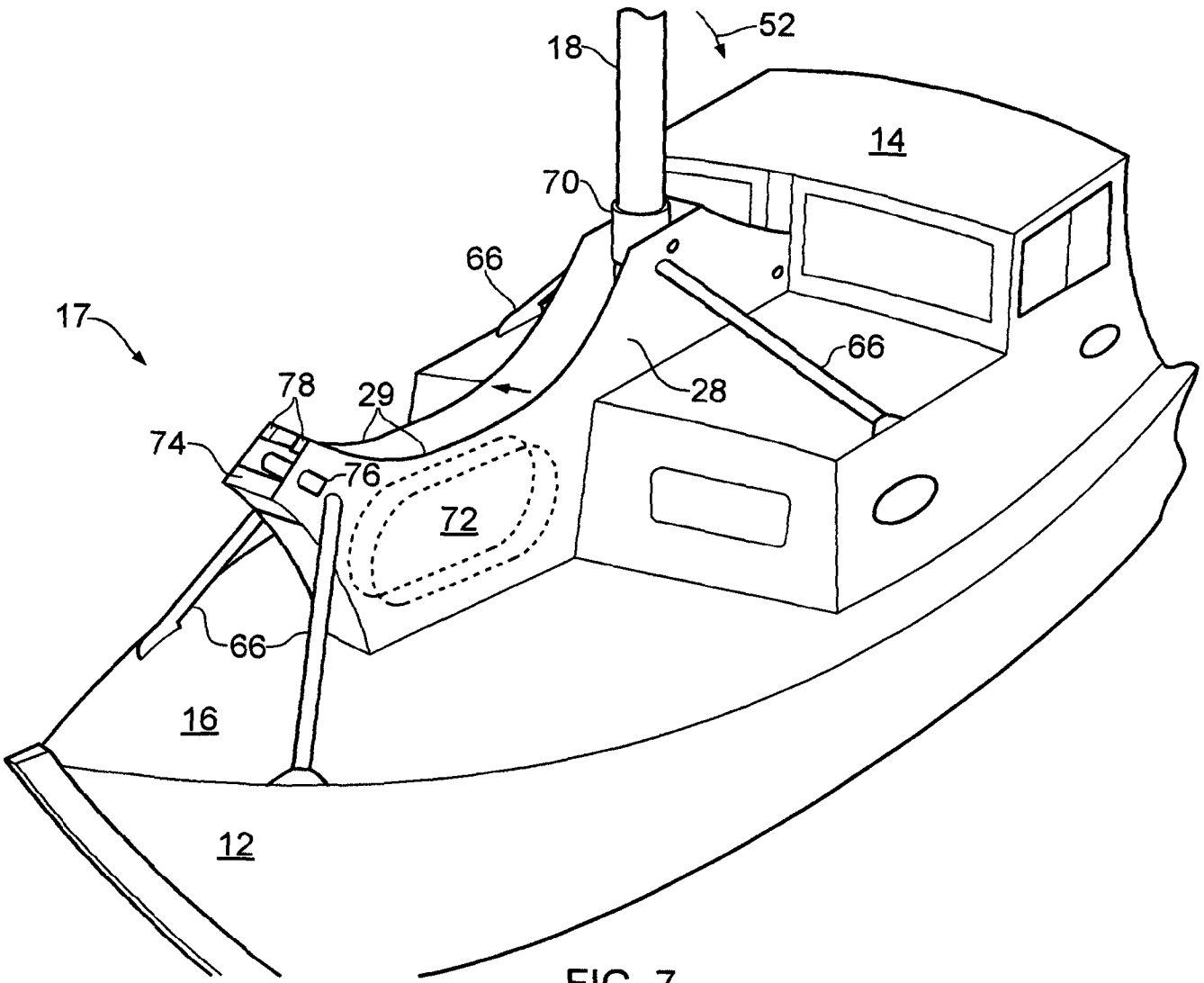
FIG. 7 shows the vessel of FIGS. 5 and 6 in a front perspective view with the mast in an upright position.
Figure 8:
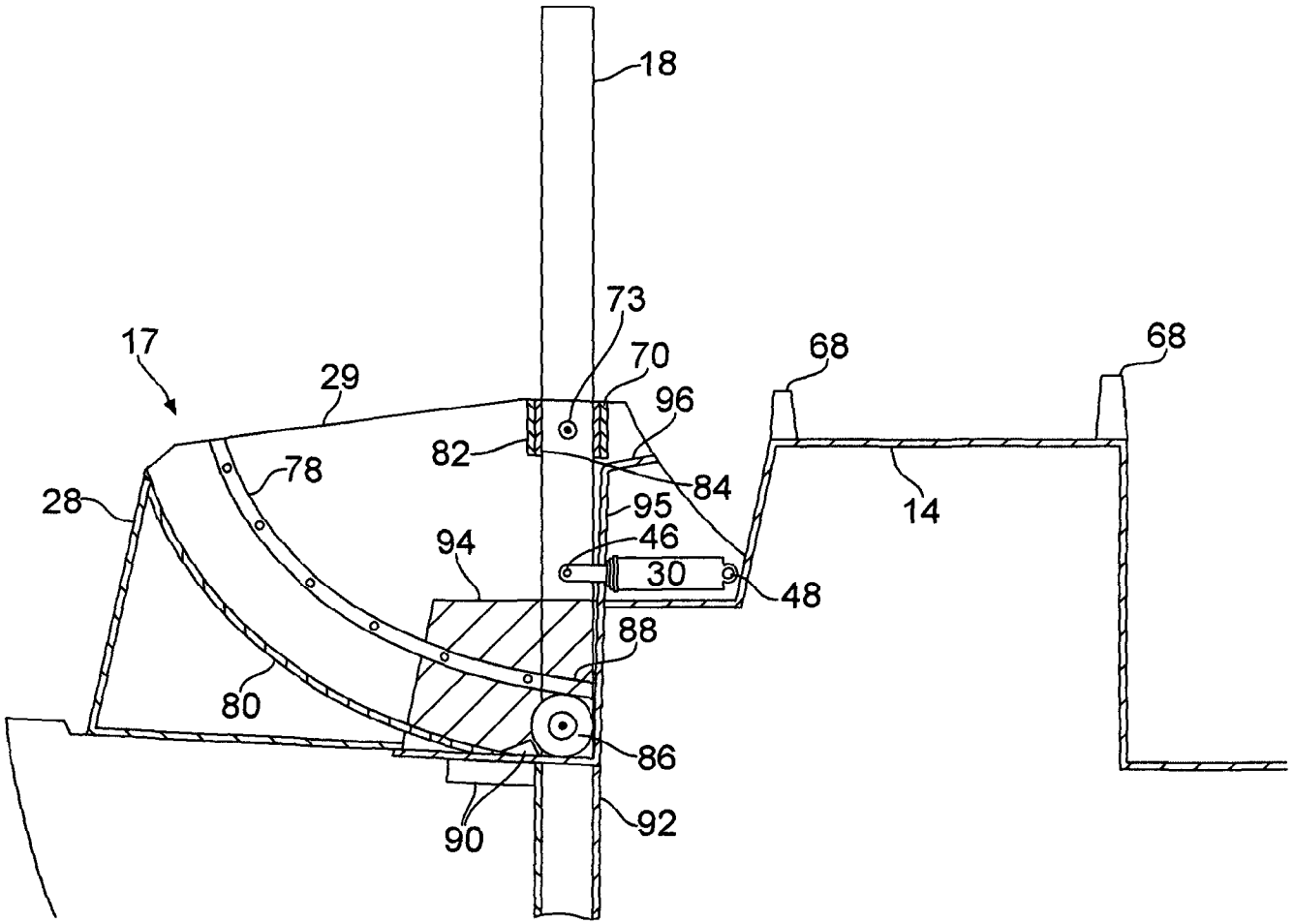
FIGS. 8 and 9 show side, cross-sectional views of a vessel according to a further example embodiment of the invention, with the mast raised and lowered respectively.
Figure 9:
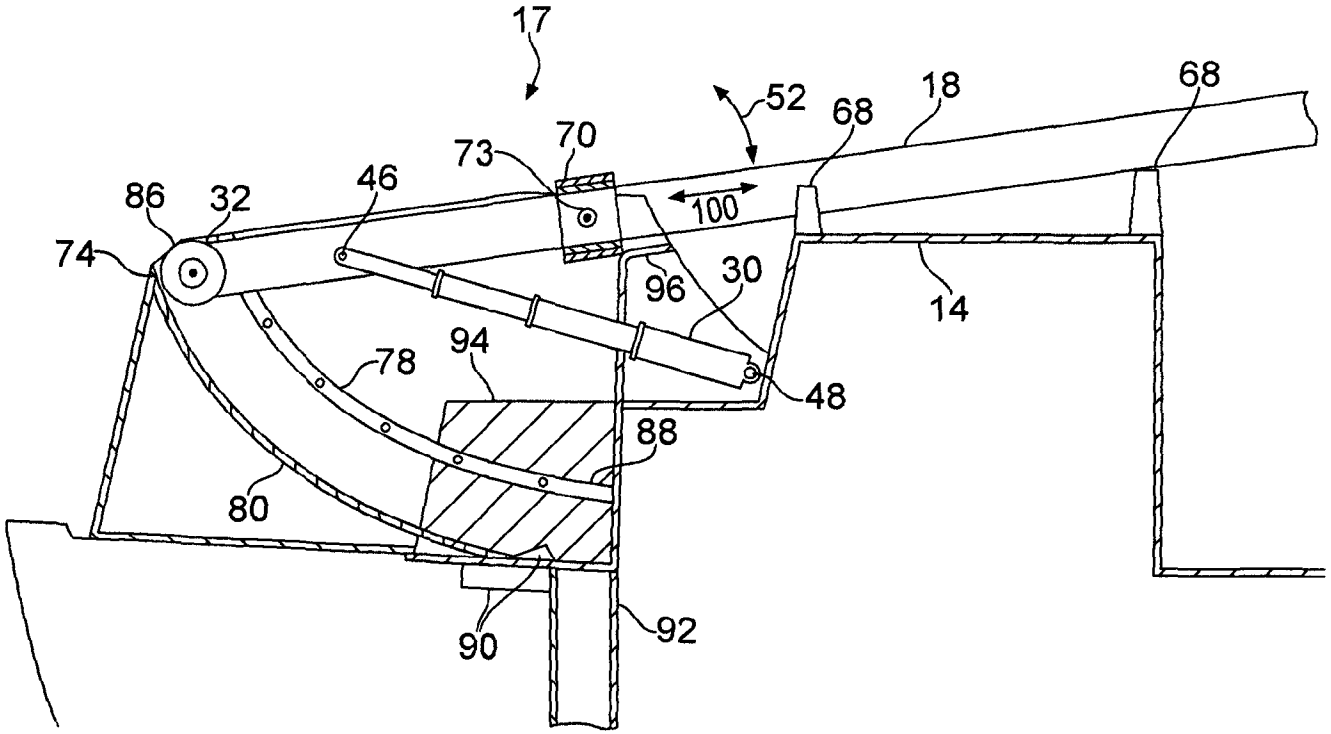
Figure 10:
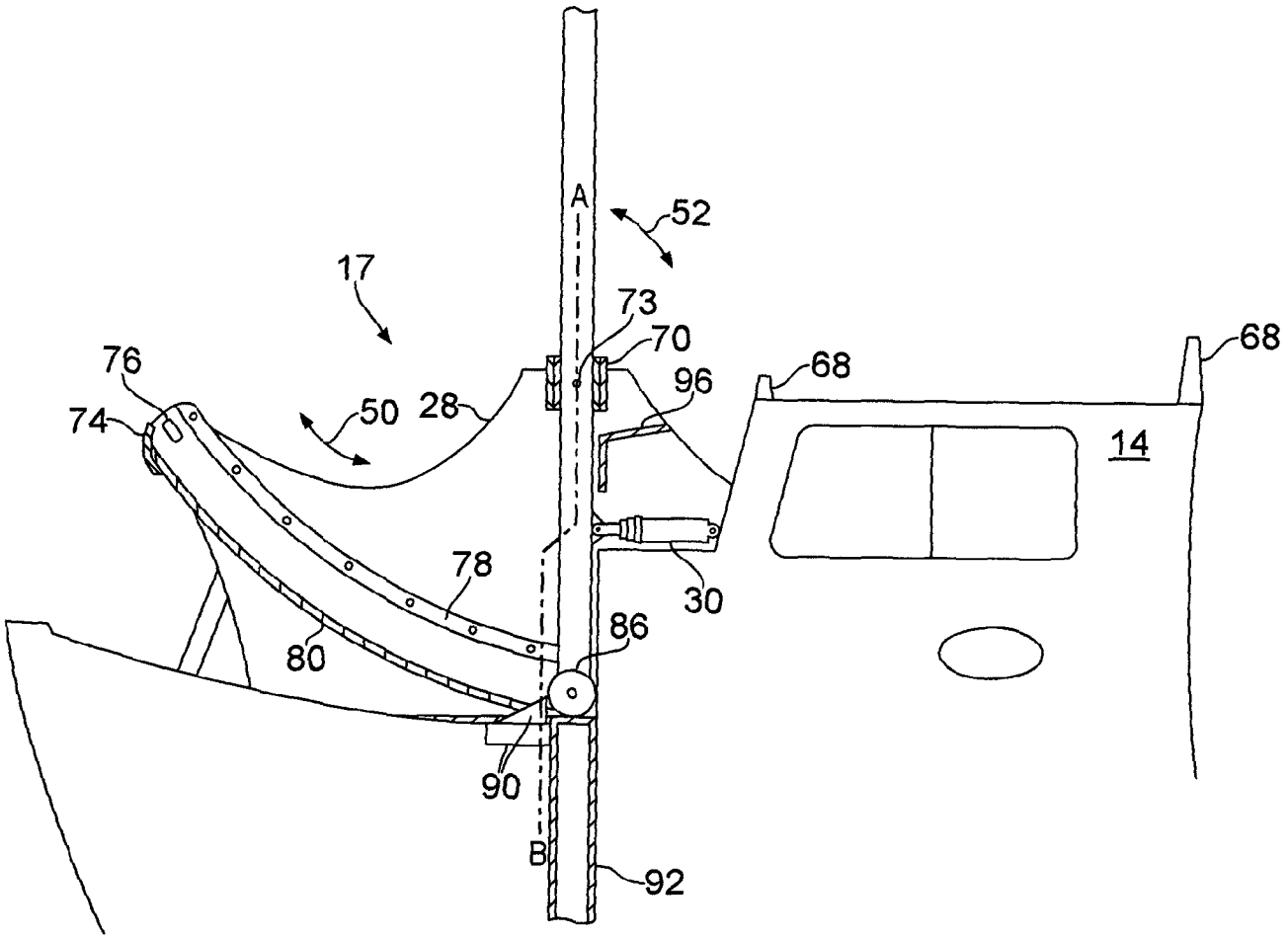
FIGS. 10 and 11 show side, cross-sectional views of a vessel according to a further example embodiment of the invention, with the mast raised and lowered respectively.

Referring now to FIGS. 5, 6 and 7 an alternative embodiment of the present invention is shown. Mast housing 28 has optional side supports 66. Two optional forward side supports 66 connect to deck 16 and/or hull 12 and two optional rearward side supports 66 connect to cabin 14 to stabilise mast housing 28. Mast housing 28 comprises two substantially parallel, spaced, upwardly extending walls 29. The space between walls 29 provides a recess for mast 18 to travel within. In this example embodiment part of mast housing 28 lies within cabin 14 (as shown by the shaded area 94 in FIGS. 8 and 9). One or more spaced crutches 68 are provided on the roof of cabin 14. Here two crutches 68 are shown.

In this example embodiment, mast support housing 28 is pivotally connected to a pivoting collar 70. Pivoting collar 70 has two protruding spigots 73 to form a pivot on either side of its outer surface for engaging with suitable mountings, such as through holes, in mast housing 28 to enable the pivoting collar to pivot with respect to the mast housing 28. Pivoting collar 70 is typically slightly larger in cross-section than mast 18 and typically has the same cross-sectional shape, for example circular, although this need not be the case.

Mast housing 28 optionally has one or more through holes 72 to reduce the leeway effect caused by having equipment on deck which can catch the wind and subject the vessel to leeway drift.

L1 is the length of the mast above the pivoting collar when the mast is in the upright position. L2 is the length of the mast above the pivoting collar (to the right of the pivoting collar in FIG. 6) when the mast is in a lowered position, for example, when stowed on crutches 68. The pivot is provided by spigots 73 (seen in FIGS. 8 to 12) of pivoting collar 70 and associated mountings in mast housing 28. The lateral movement control mechanism for enabling controllable lateral movement of the mast with respect to the pivot comprises, in this example embodiment, the pivoting collar 70.

To lower the mast, hydraulic ram 30 pushes away in the direction of arrow 50 away from the mast housing 28 causing the mast to travel about the pivoting collar 70 in the direction of arrow 52 and also laterally through the pivoting collar 70. Thus, the distance L1 of the mast beyond the pivoting collar 70 when the mast is erect is longer than the distance L2 of the mast beyond the pivoting collar 70 when the mast is in a lowered position. A typical total mast length is around 4 to 8 m or more typically around 6 m, such as 5.8 m. Typically the mast when upright is positioned around ⅓ the length of the vessel from forward and ⅔ from aft of the vessel. A typical distance L1 is 4.75 m. A typical lateral distance of travel of the mast with respect to pivoting collar 70 is 0.1-0.5 m, or more typically about 0.3 m, for example for a 4.75 m long mast. For a 16 m vessel with a mast of around 13 m in length, a typical lateral distance of travel might be 1-1.5 m. Typically the lateral distance travelled as a mast is lowered is sufficient for that mast length and length of the vessel so that the mast lies within the boat length (i.e. within the periphery of the vessel so that it does not protrudes beyond the vessel) when in a lowered position. This lateral motion of the mast enables the mast to be positioned when upright in a suitable sailing position for a sail mast about ⅓ form forward and ⅔ from aft of the length of the vessel and yet lie within the vessel when lowered.

Referring now to FIGS. 8 to 12, two similar example embodiments of a mast housing utilising a pivoting collar 70 are shown. The mast housing 28 comprises two upstanding walls 29, spaced apart and generally parallel to one another. The lateral movement control mechanism for enabling controllable lateral movement of the mast with respect to the pivot and the mast housing comprises, in this example embodiment, rotatable pivoting collar 70 and, optionally, in a preferred example embodiment, a guideway for the mast, for example, for the mast heel 32.

The pivoting collar 70 comprises pivoting collar spigots 73 for locating the pivoting collar 70 in pivoting relation with walls 29 of mast housing 28. The pivoting collar 70 comprises a substantially circular, outer collar 82 made, for example, from aluminium or stainless steel. The pivoting collar 70 further comprises an inner collar bearing 84 having an inner bearing surface for allowing lateral movement of the mast therealong. The inner collar bearing 84 is typically generally located concentrically inwardly of the outer collar 82 and may be made of some suitable low friction material such as nylon or PTFE.

Mast housing 28 may comprise one, or as in this example embodiment two, guideways for enabling controlled movement of mast 18. A lower guideway 80 may be formed from a curved surface spanning between the side walls 29 of mast housing 28 along which curved surface mast heel 32, or a lower portion of the mast below the pivot, can travel in a controlled manner. An end stop 74 is located at the end of lower guideway 80 to limit the movement of mast heel 32 beyond lower guideway 80.

An upper guideway 78 formed, for example, from a pair of opposing curved, flat bars, may also be provided for controlling rotational and lateral movement of mast 18. The mast heel 32, or a lower portion of the mast below the pivot, may be provided with one or more mast guide wheels 86 for engaging with one or both of lower guideway 80 and upper guideway 78. These form, in this example embodiment, the lateral movement control mechanism. Upper guideway 78 may have a flat edge provided by a square or rectangular cross-section for engaging with one or more the guide wheels 86 and enabling smooth running of the guide wheel(s) 86 whilst preventing it lifting out of the mast housing 28. Similarly, large guide wheels having a diameter greater than diameter of the mast are advantageous as this allows more robust and sure movement along the upper and lower guideways 78 and 80. Also, the diameter of the wheels being larger than the length of guide rail 88, and larger than the separation of the two opposing guide rails forming upper guideway 78 further restricts the guide wheel(s) 86 from moving upwards because the guide wheel(s) may be too large to pass through upwardly. This restricts the mast from lifting upwards.

A recess 96 in a mast housing rear wall 95 is provided to accommodate pivoting of mast 18 to a lowered position without restriction. A mast housing keel support 92 is provided beneath mast housing 28 adjacent the region occupied by mast 18 when it is in an upright position to transmit the weight of the mast to the keel and provide a more stable positioning of the mast 18 when upright above the keel.

A mast heel securing device 90 is provided at a lower end of lower guideway 80 to lock guide wheel(s) 86 (or mast heel 32 if no guide wheel(s) is/are provided) and hence mast 18 in an upright position. Further upper guideway 78 comprising two opposing curved rails continues at 88 to a rear wall 95 of mast housing 28 to prevent guide wheel(s) 86 (or mast heel 32 if no guide wheel(s) is/are provided) from lifting out of the mast housing 28 (for example due to sail lift). The mast housing 28 shown in FIGS. 10 and 11 has a recessed uppermost edge to reduce leeway effect on the exposed mast housing 28 due to wind.

The hydraulic ram 30 is telescopic to increase the distance the mast heel is pushed out when lowered and reduce the housing area of the ram when the mast is raised.

Figure 12B:
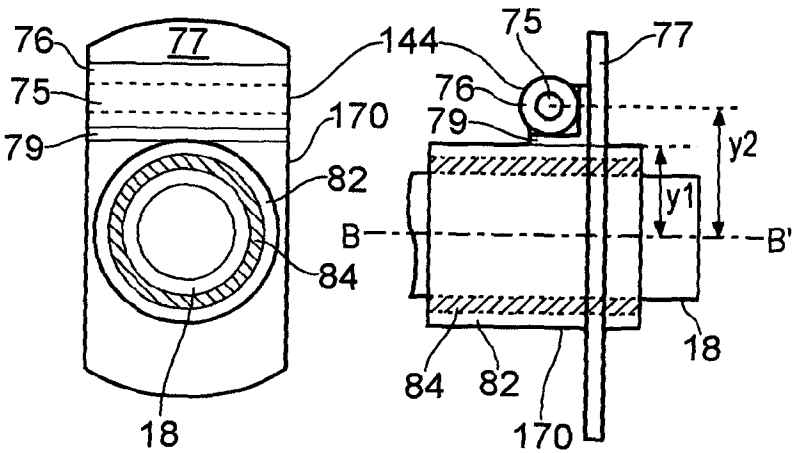
FIG. 12B shows plan and side elevation views of an alternative pivoting collar in the form of an offset pivoting collar with an offset pivot according to a further example embodiment of the invention.
Figure 12A:
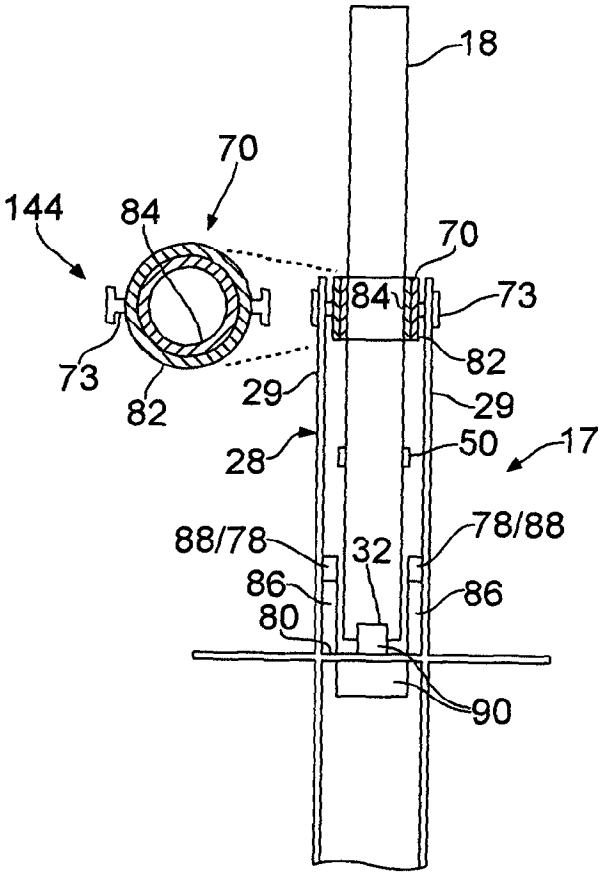
FIG. 12A shows a front, cross-sectional view along line A-B of the mast and housing of FIGS. 10 and 11 with the mast in an upright position.

As can be seen in FIG. 12A, two guide wheels 86 are provided one on either side of mast 18 and the guide wheels are fitted with bearings to an exile through the mast (not shown). These may be located at or adjacent the mast heel 32, or on a lower portion of the mast below the pivot of the mast housing 28. Also seen here are side walls 29 of mast housing 28 that extend some distance up mast 18, providing a recess for mast 18 to be robustly supported against lateral movement such as sway. The mast is supported at its heel by the guideway 80 Guide wheels 86 facilitate controlled movement of the heel of the mast along curved lower guideway 80 enabling the mast to be moved in a controlled manner both around the pivot 44 and laterally forward. This enables the mast position to be controlled when upright and when lowered so as, for example, the mast to be generally or substantially centrally located within the periphery of the vessel to reduce the effect of the mast location on the nominal centre of gravity of the vessel, and/or so that the mast does not protrude beyond the periphery of the vessel and cause difficulties with judging the length of the vessel during manoeuvring. The rotating collar pivot 70 allows the mast to pivot and slide through. Within this collar is a nylon bearing to reduce friction. The guide wheel(s) 86 assists the heel of the mast to follow the trackway without restriction and as these follow the guideway; this ensures the mast moves forward as it is lowered.

The mast housing 28 provides a secure and fixed support for the mast. It can be partly or wholly contained within the vessel's deck, cabin or superstructure. The housing is supported directly beneath the mast down to the keel at 92 (see FIG. 10). The housing support 92 will take the downward forces from the mast housing down to the keel. The upper and/or lower guideway 80 gives the guide wheel a support and track to follow as it moves forward and up. This curved plate will also strengthen the mast housing 28. The mast heel securing device 90 locks the mast in position automatically once the hydraulic ram 30 has erected the mast 18. This locking device 90 may be spring loaded to lock and then be unlocked from within the cabin 14 to release before the mast 18 is lowered. The flat bar wheel upper guideway 78 keeps the guide wheel down onto the lower guideway 80.

To lower mast 18 a switch in the cabin activates the hydraulic ram 30. The hydraulic ram 30 situated between mast housing 18 (FIG. 8), or an upwardly extending surface of cabin 14 (FIG. 10), and a region of mast 18 below pivot 73, extends. The lower portion of mast 18 below pivoting collar 70 is pushed away from the cabin 14. Guide wheel 86 rests on and travels along lower guideway 80. Further, guide wheel 86 is held in position on lower guideway 80 and prevented from drifting up by upper guideway 78. When guide wheel 86 reaches its end of travel along upper and lower guideways 78 and 80, it is prevented from further travel by end stop 74. Crutches 68 are arranged to encounter mast 18 as guide wheel 86 encounters end stop 74. The mast 18 has rotated about pivot 73 and simultaneously travelled laterally forward through pivoting collar 70 along the inner bearing surface of inner bearing 84.

To raise the mast, a switch typically located in the cabin, activates the hydraulic system to retract the hydraulic ram causing the guide wheel 86 on mast heel 32 to disengage from end stop 74. The guide wheel 86 is caused to travel along lower guideway 80 beneath upper guideway 78 until the mast is in an upright position sitting above mast housing keel support 92. In this position the guide wheel 86 has passed beyond locking mechanism 90 which may be releasably spring loaded to lock mast 18 in an upright position by rising behind guide wheel 86 as it travels past. Region 88 of the pair of opposing rails forming guideway 78 prevent the guide wheel 86 and hence mast 18 from rising out of mast housing 28. The mast is controllably pivoted and laterally moved (from left to right in FIG. 8) to be in position above mast housing keel support 92.

In this embodiment, the weight of the mast is carried largely by lower guideway 80 so that much less weight is placed on pivoting collar 70 and spigots 73 forming a pivot. Thus, ease of movement of mast 18 through pivoting collar 70 and spigots 73 in mast housing 28 is facilitated and pivoting collar 70 and spigot 73 endure less wear and tear. Further, in this and other embodiments, the location of the mast heel 32 is controlled so as to follow a defined path (provided by the one or more guideways in pivot trackway 34, upper guideway 78 and lower guideway 80) as the mast is raised and lowered Location of the pivot at an upper portion of the mast housing 28 and above the deck assists in providing working height L3 for crew to operate fishing gear without interference from lowered mast 18. Further advantages and embodiments will be apparent from the disclosure herein.

FIG. 12B shows plan and side elevation views of an alternative pivoting collar in the form of an offset pivot pivoting collar 170. Offset pivoting collar 170 has an outer collar 82 and an inner collar bearing 84 as described elsewhere in relation to other embodiments. Offset pivoting collar 170 optionally, further comprises a mounting plate 77 which, in this example embodiment, is a generally rectangular plate extending outwardly from and surrounding outer collar 82. Offset pivoting collar 170 comprises an offset pivot mount 76 which has an offset pivoting through-bore 75. Pivot mount 76 may be a cylindrical tube, as shown here, and may be comprised of stainless steel. Thus, a pivot 144 is provided comprising an offset pivoting through-bore and, typically a pivot pin (see 175 in FIGS. 12C and 12D) about which the through-bore 75 can rotate.

Offset pivoting through-bore 75 lies to one side of the outer collar 82. Thus, the pivot 144 is positioned offset from a centreline along the longitudinal central axis BB' of mast 18 (which is typically coincident with corresponding longitudinal axes of inner bearing 84 and outer collar 82). The outer surface of the outer collar is a distance y1 from axis BB'. Optionally, as shown here, the offset pivot 144 lies a distance y2 from axis BB' outside the outer periphery of outer collar 82. Thus, the offset pivoting though-bore 75 is offset at a defined distance y2 from the longitudinal central axis BB' of mast 18. The offset pivoting through-bore 75 may be located immediately adjacent to the outer periphery of outer collar 82 so that y2 is equal to or close to y1, or, indeed, within the outer periphery (so that y2<y1) although this is less favourable. By offset it is to be understood that the axis of rotation of pivot 144 (defined by the centreline of through-bore 75) does not pass through the longitudinal axis BB' of mast 18 or, if no mast is present, does not pass through the mast's intended position within inner bearing 84 and outer collar 82.

The pivoting collar 170 may comprise, as shown here, a mounting plate 77 extending in one or more directions beyond the periphery of the outer collar 82 so that the offset pivoting through-bore 75 can be mounted in relation to the outer collar 82. Here, a mounting support 79, typically, of right angle cross section is also provided to facilitate mounting of the pivot mount 76 to the outer periphery of outer collar 82 and to mounting plate 77. Typically the plate 77 and mounting support 79 are welded together and welded to the outer collar 82 although other forms of fixing can be envisaged. Typically these are also made from metal such as stainless steel. Other materials and methods of fixing may be used.

Figure 12C:
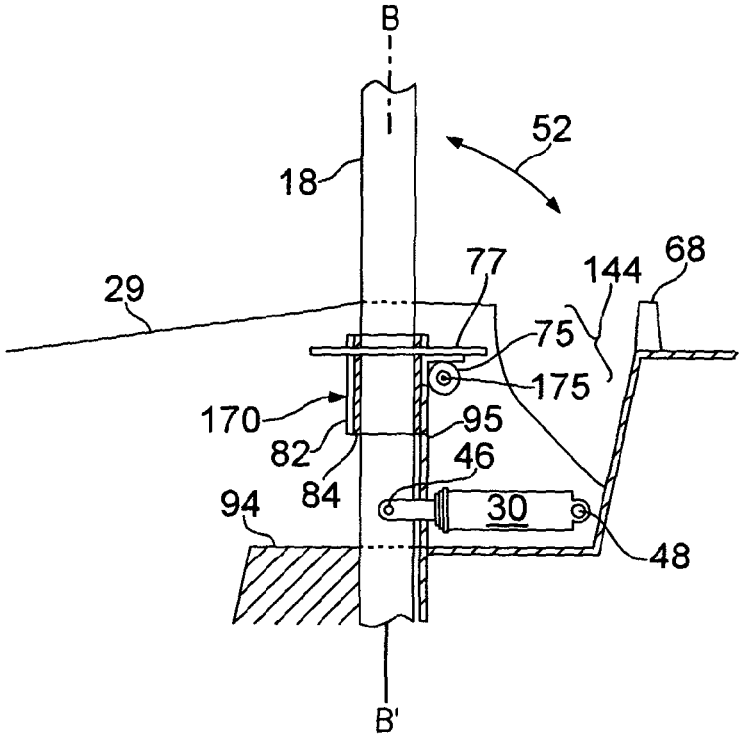
FIGS. 12C and 12D show side, cross sectional views of an upper part of a vessel having an offset pivoting collar with an offset pivot, according to a further example embodiment of the invention, with a mast in raised and lowered positions respectively.
Figure 12D:
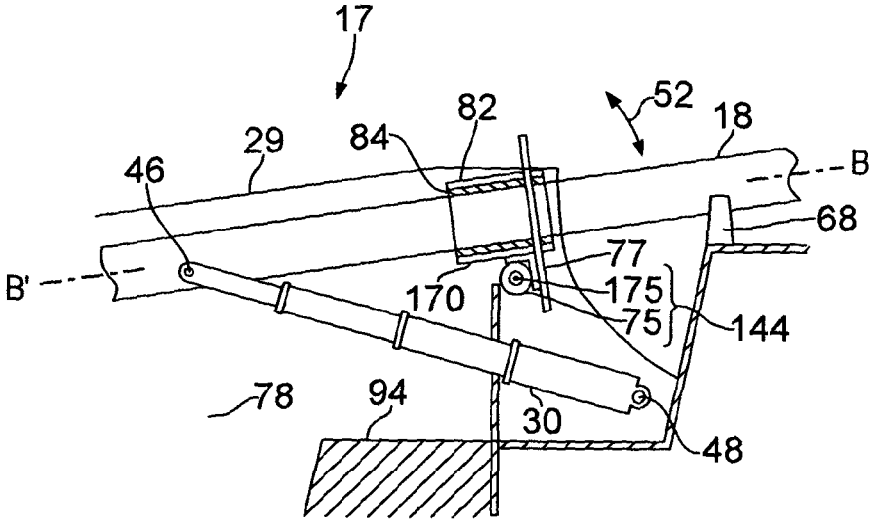

FIGS. 12C and 12D show a mast 18 on a vessel in, respectively, upright and lowered positions. An offset pivot 144 is provided by means of an offset pivoting collar 170 which is offset from the longitudinal axis BB' of mast 18. An offset pivoting through-bore 75 and an offset pivot pin 175 extending therethrough and further extending between upwardly extending walls 29 of mast housing 28 (not shown) are provided. In this example embodiment, the offset pivot 144 lies beyond the outer periphery of the outer collar 82. This particular location of an offset pivot assists in enabling secure fixing of a pivot mechanism (here a pivot mount 76 and offset pivoting through-bore 75) to the outer collar 82. This is achieved preferably utilising a mounting plate 77 and optionally a right angle mounting support 79 to mount the pivot mount 76 to, for example, the outer collar 82.

In an alternative embodiment, the offset pivoting through-bore 75 may be provided within a peripheral wall of the outer collar 82. The outer collar is typically circular in cross-section but it may have another outer peripheral shape for the purpose of providing a through-bore, such as square or rectangular or octagonal. Typically the shape of the inner peripheral surface of the outer collar matches the shape of the outer peripheral surface of the inner collar and is, preferably, substantially circular in cross-section.

Whilst an offset pivot in the form of an offset pivoting through-bore is provided, an offset pivoting cross bar or a pair of offset pivoting spigots could be used as alternatives (typically, for example, fixed to the outer collar via a mounting plate 77). Other alternatives of pivoting mechanisms and fixing arrangements foreseeable by those skilled in this art from this disclosure also lie within this invention.

To lower the mast, a drive member, here in the form of a hydraulic multistage ram 30 is activated. This pushes the base of the mast away from its stepped position and causes the mast to rotate in the direction of arrow 52 about the pivot 144 provided by the offset pivoting through-bore 75 and associated offset pivoting cross spar such as stainless steel pivot pin 175. Further, during rotation, the mast 18 travels in a controlled manner through the inner collar bearing 84 of offset pivoting collar 170 so as to move the mast laterally in a controlled manner as it is lowered. To raise the mast, the steps are reversed until the mast resumes a stepped position on the vessel.

The purpose of the offset pivot point is to provide strong, robust construction of the pivoting collar 170 whilst enabling the advantages of the controllable movement of the mast. Furthermore, where, an optional mounting plate 77 and/or optional mounting support 79 are provided, substantial welding can be achieved on the large surface areas provided by these components to enhance maximum strength of the joins. Whilst lowering and raising the mast the pivot point 144 will be subject to stress therefore the extra strength provided by this arrangement is advantageous. With this design, once lowered the weight of the mast actually lies on the heavy stainless steel pivot pin 175 rather than on welded lugs on either side of the collar as in other embodiments.

The pivoting collar 70, 170 typically extends around the circumference of the mast, but it need not do so. It is sufficient that the pivoting collar extends sufficiently around the mast so as to support the mast 1) in a raised position (to prevent the mast falling over when raised), 2) in a lowered position, to carry the mast and 3) in in-between positions so that the mast is securely located during motion of the mast between raised and lowered positions.

Figure 13:
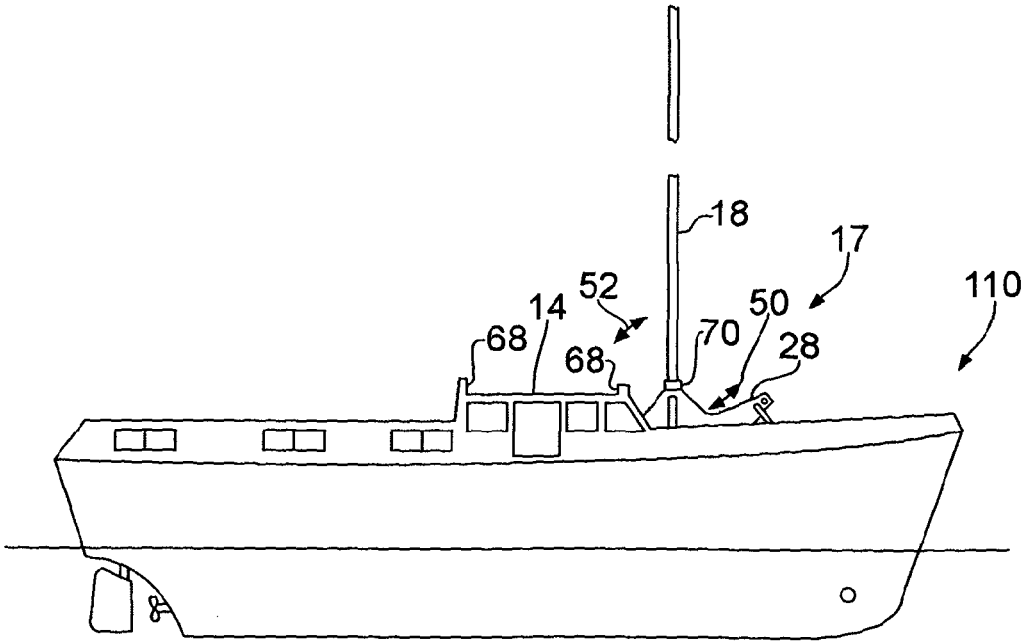
FIG. 13 shows a side elevation view of a larger vessel incorporating a mast apparatus according to the invention.

FIG. 13 shows a larger vessel 110 incorporating a mast apparatus according to the invention for use with a sail.

Figure 14:
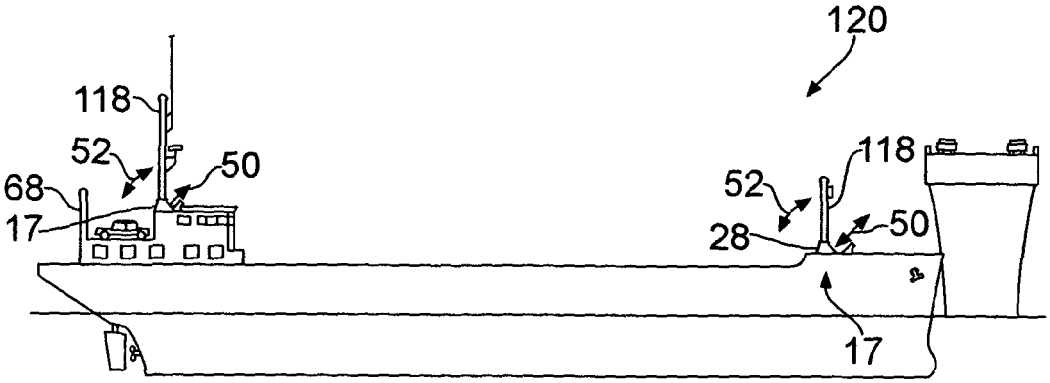
FIG. 14 shows a side elevation view of a further application of a mast apparatus according to the invention.

FIG. 14 shows a much larger vessel 120 incorporating mast apparatus according to the invention for use as radio or wireless masts 118. Mast crutches 68 are arranged to receive the masts when in a lowered position.

FIGS. 15 to 18 are similar views to those of FIGS. 3 and 8 to 12 and show further alternative embodiments of the invention. Here, the mast 18 comprises an elongate pivot trackway 34 and is mounted on a mast housing pivot 44 to mast housing 28. A compression spring 45 is connected between pivot 44 and mast heel 32.

Whilst here a compression spring is used in compression, it will be appreciated that alternative arrangements to the same effect can be envisaged using a compression spring under extension, a shock absorber, or other resilient members such as elastomeric members under compression or extension.

Figure 15:
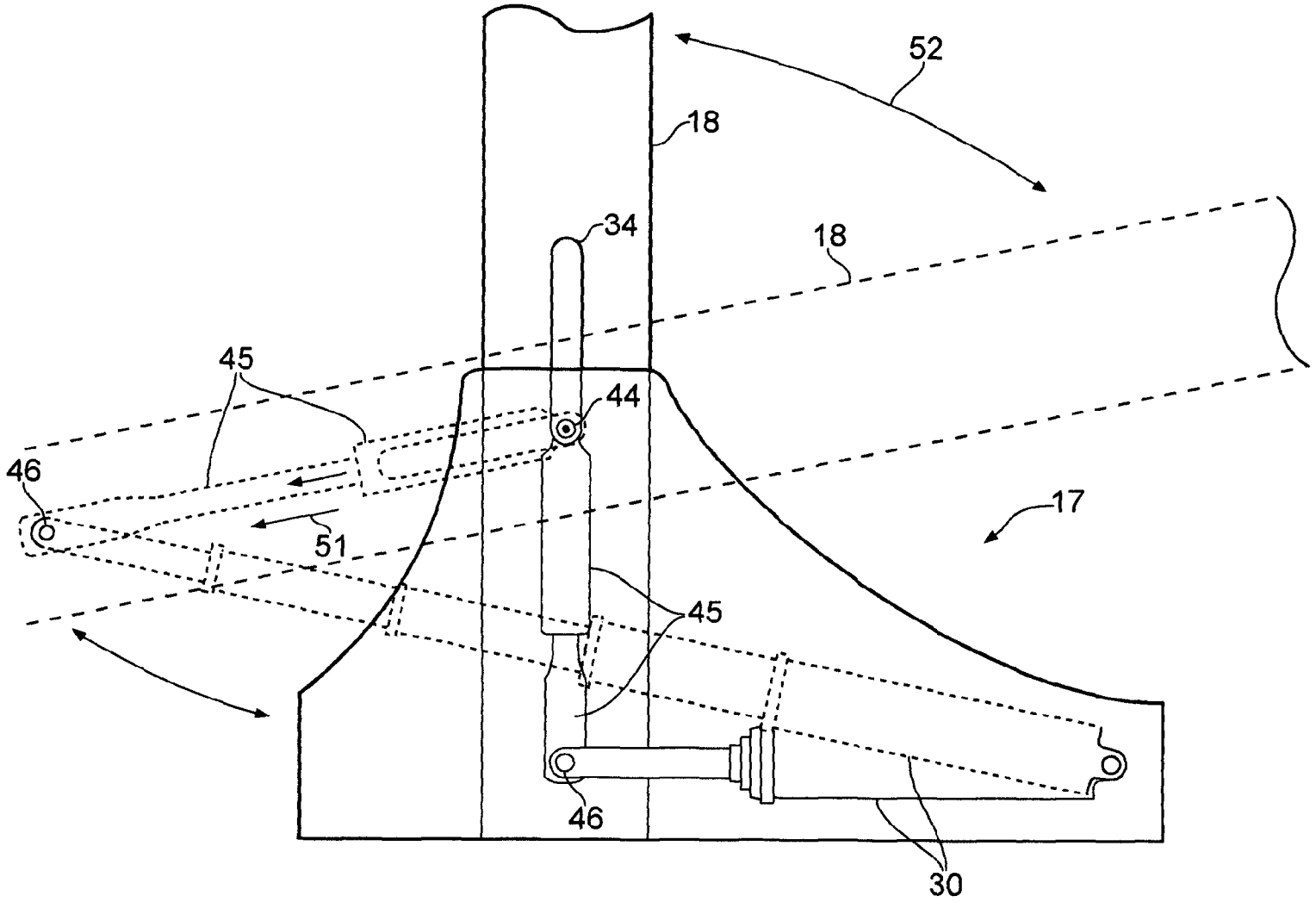
FIG. 15 shows a close-up side elevation view of a mast apparatus, for raising and/or lowering a mast, according to a further example embodiment of the invention.

In this example embodiment, the compression spring 45 is in compression when the mast is upright. In FIG. 15, no lower guideway 80 is provided in the mast apparatus 17. However, in the further example embodiment seen in FIGS. 16, 17 and 18, a lower guideway 80 is provided, which is here upwardly and forwardly curving, to guide mast heel 32. Lower guideway 80 has a recessed slot for receiving, in this example embodiment, a single narrow, guide wheel 86. Here, a single narrow guide wheel 86 is provided centrally with respect to the cross section of the mast, but two or more guide wheels and/or one or more smooth bearing surfaces for mast heel 32 may be provided on mast heel 32.

Figure 16:
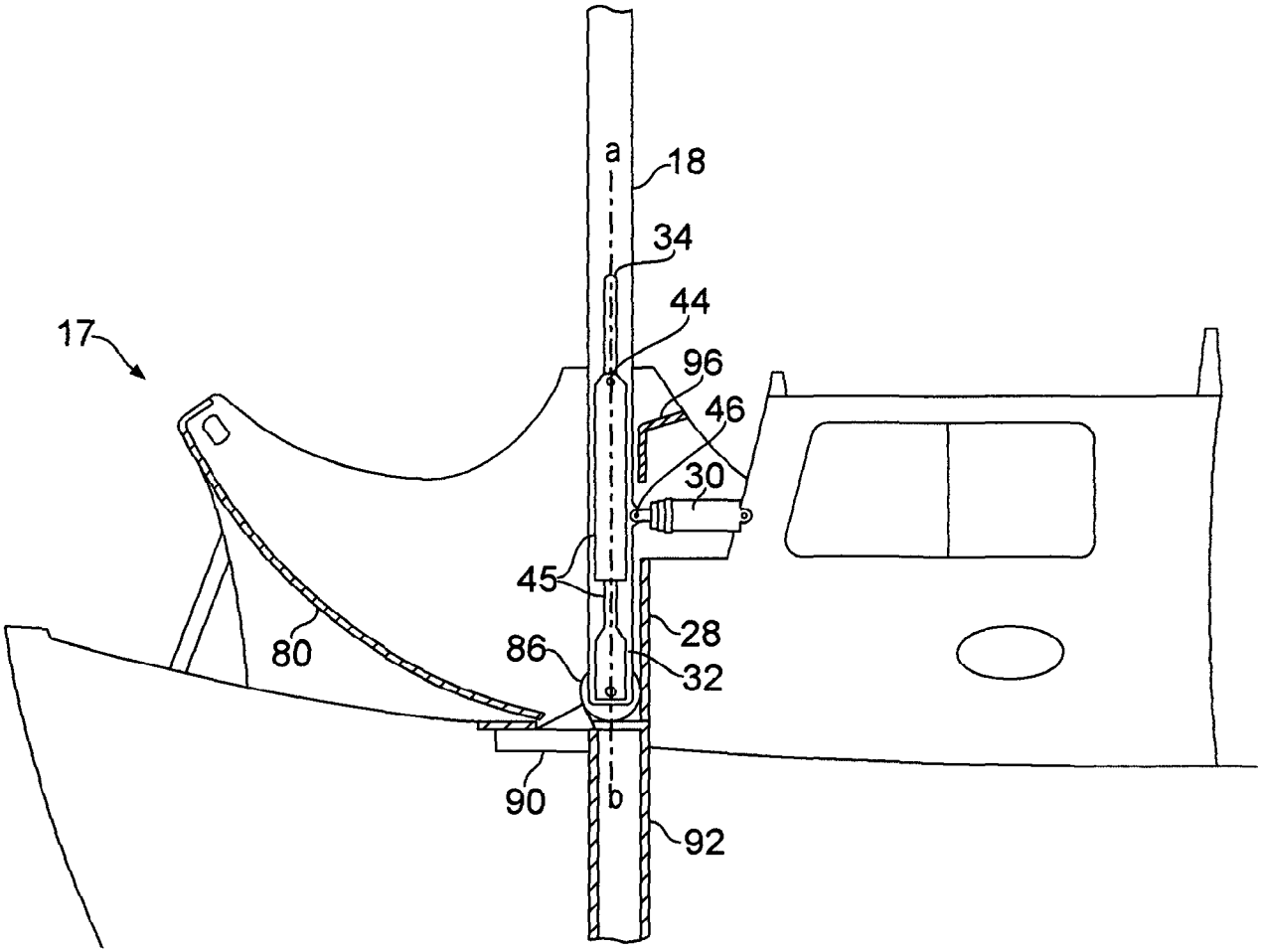
FIGS. 16 and 17 show side, cross-sectional views of a vessel according to a further example embodiment of the invention, with the mast raised and lowered respectively.
Figure 17:
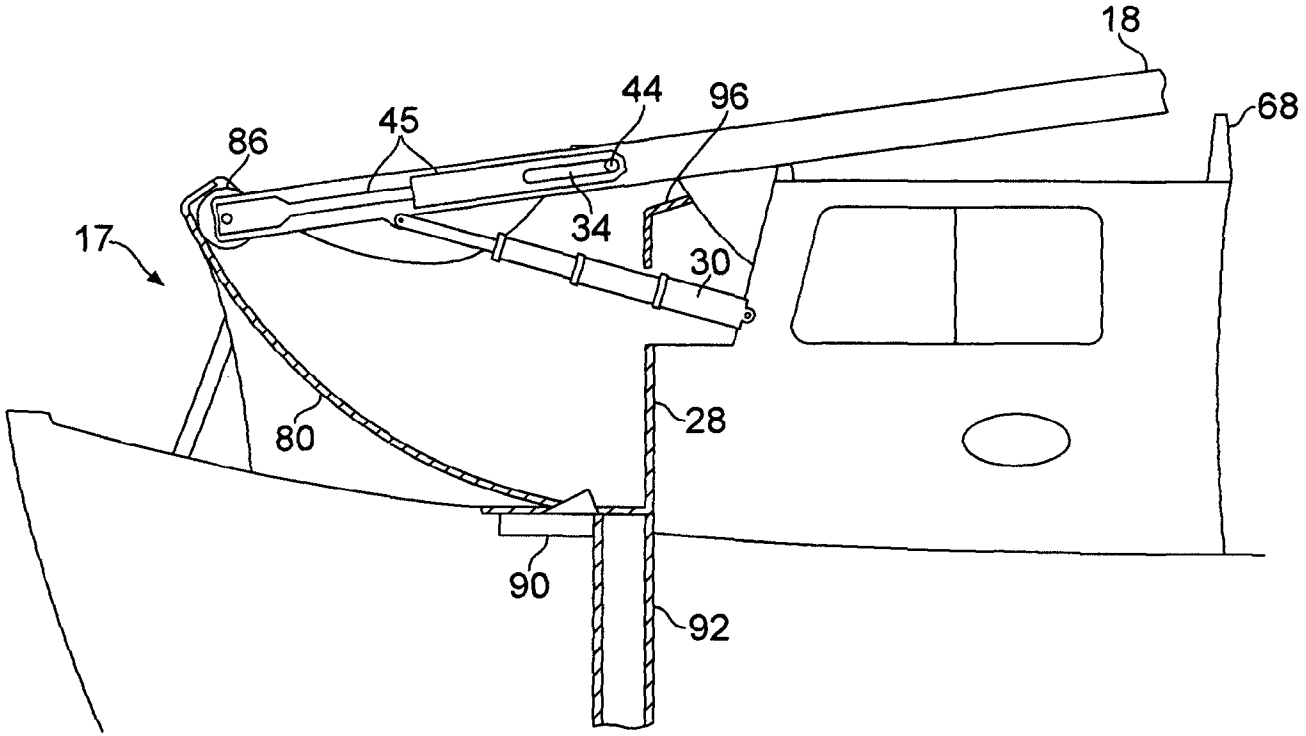
Figure 18:
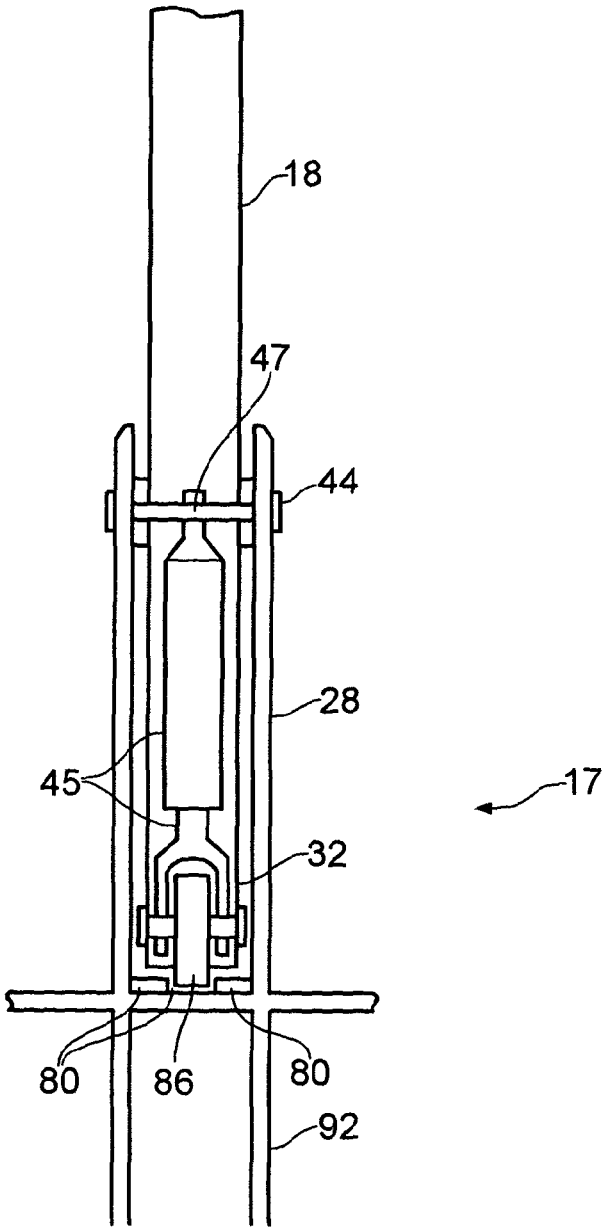
FIG. 18 shows a front, cross-sectional view along line a-b of the mast and housing of FIGS. 16 and 17 with the mast in an upright position.

To lower the mast the mast heel securing device 90 is released, for example, under hydraulic control by pressing a switch optionally in the cabin 14, or automatically, and the multistage ram 30 is activated for example, under hydraulic control by pressing a switch optionally when in the cabin 14. The multistage ram 30 is driven to the left (as seen in FIG. 16) forcing the mast to rotate about pivot 44 and guide wheel 82 to travel along lower guideway 80. The guide wheel 82 is pressed into lower guideway because the compression spring 45 is connected in compression between pivot 44, fixed to mast housing 28 at pivot point 47, and the guide wheel 86 at mast heel 32. Thus the mast heel 32 is positively pushed downwards away from the pivot 44 towards the lower guideway 80. The guide wheel 86 (and associated mast heel 32 to which it is fixed) is positively located in the lower guideway 80 as the mast rotates about the pivot 44 of mast apparatus 17. The position of the mast heel 32, is carefully controlled. The mast apparatus 17 provided by the pivot and the lateral movement control mechanism (in the form of the pivot track way 34 or the pivoting collar in another embodiment and optionally in combination with a lower guideway 80, where one is provided) enables the position of the mast to be controlled upon lowering and/or raising.

The compression spring 45 is still in compression, although less so, when the mast 18 reaches it's fully lowered position. This positive location of the guide wheel 86 into the lower guideway 80 may be provided by other resilient members arranged in a different way.

In the embodiment in FIG. 3, the lateral movement control mechanism is provided by the pivot trackway 34. In the embodiment shown in FIGS. 5, 6 and 7, the lateral movement control mechanism is provided by the pivoting collar 70 and the guideways 78 and 80. In the embodiment shown in FIGS. 8 to 12 the lateral movement control mechanism is provided by the pivoting collar 70 and the upper and lower guideways 78 and 80. In the embodiment shown in FIG. 15 where no lower guideway is provided, the lateral movement control mechanism is provided by the pivot trackway 34 and a resilient member in the form of compression spring 45. In the embodiment seen in FIGS. 16 to 18 the lateral movement control mechanism is provided by the pivot trackway 34, a resilient member in the form of compression spring 45 and a lower guideway 80. Thus, these and various other combinations of one or more of these features for providing a lateral movement control mechanism may be envisaged by someone skilled in the art from the disclosure herein.

The skilled reader will appreciate from reading the disclosure in this application that the present invention alleviates or reduces the problems already described and the following problems. It provides a commercial vessel such as a fishing vessel with the ability to use sail power as and when circumstances and conditions dictate, thus reducing the major expense of fuel and its carbon emission in the process. The present invention may also provide the ability to lower the mast whilst at sea improving the stability and leeward effect on the vessel, particularly in heavy weather. The system of the present invention could also be described as an integrated sail/motor propulsion system. Furthermore, for various seagoing craft the ability to lower your mast to pass under bridges is useful to reduce air draught. In addition, in one example embodiment, to reduce the risk of damage to the mast and hazard to other shipping, the system may be designed for the mast when lowered not to extend out over the stem of the vessel. Furthermore, a lowered mast typically reduces the angle of heel created in strong winds whilst alongside. Also, maintenance and repairs to the mast and rigging could be undertaken whenever it was necessary. It should also be appreciated that the mast in a mast apparatus of the present invention may also be easily removed when in the lowered position.

A mast that can be operated hydraulically is likely to be virtually indispensible onboard a commercial vessel powered by sail and engine to ensure its ability to sail is compatible with commercial fishing. Other driving mechanisms can be considered, such as electric, or manual, but as hydraulic systems are typically available on board fishing vessels, these can advantageously be extended for use in the present invention.

In an example embodiment, the hydraulically operated mast apparatus has been designed in order to avoid most, if not all, of the manual handling of the equipment. The mast is raised and lowered through the activation of hydraulics from within the wheel house. It is also locked automatically and released from below decks. The mast housing can be placed below decks to avoid obstruction of other equipment and this will also lower its centre of gravity. The aim of this sail system is to create a simple rig which can be easily managed by one person and has high efficiency between performance and costs. The switch between sail power and motor is effectively seamless to achieve compatibility with the fishing activity. To windward, the rig of FIG. 1 is not the best acting rig, but it is simple, easy to repair and maintain. It will give relative low forces on the existing boat. Between 60 degrees from the wind to downwind the rig is very efficient.

The hydraulically operated mast takes the sail system shown in FIG. 1 a stage further in its compatibility with fishing activity. The ability to lower your mast whilst at sea improves the stability and leeward effect on the vessel, particularly in heavy weather. The crew have the means to operate in sail or motor mode depending on your situation and the conditions.

Whilst the mast apparatus may be hydraulically powered, and this is beneficial as this is a readily available driving source on many vessels, the mast apparatus may be powered by other means such as by hand or by electricity. Indeed at least one back up means of powering the mast apparatus may be provided in case of failure of a main driving source.

The invention in several of its embodiments provides the ability to have an integrated propulsion system combining two or more means of powering a vessel's motion, combining engine, typically diesel engine and sail and being able to easily and in certain embodiments, seamlessly switch from engine to sail and back again with little effort required on the part of the crew. The control of the position of the mast at all times when raised or lowered, or during raising and lowering, enables the ease of this transition from one means of powering a vessel's motion to another, e.g. from engine to sail and back again. Thus, the mast apparatus of the present invention enables, the provision of an integrated propulsion system for a vessel combining engine and sail.

Further the present invention describes a system designed to be able to raise and lower a mast while the vessel is at sea and underway, or at any time, required, so enabling the provision of sail assisted, commercial fishing vessels.

Within the leisure sailing industry there could be a need for this system to create a simple means to lower your mast whilst operating within river bridges. River barges could also benefit from having a means to reduce their air draft.

Types of vessels which could also use the mast apparatus of the invention include but are not limited to river craft, cargo barges, coasters, multi-hulled work boats, tourist craft and yachts. These can all benefit from the removal of the restriction because of their air draft e.g. to pass under bridges etc. Whilst the mast apparatus of the invention is described and is particularly useful in relation to one or more sails, it may be used in relation to other masts, such as masts to carry aerials, navigation lights, radars in addition to or as an alternative to one or more sails.

Whilst in port for all sail craft the ability of lowering your mast would be of great benefit. This would reduce the angle of heel created in strong winds whilst alongside. Maintenance and repairs to the mast and rigging could be undertaken whenever it was necessary.

The invention claimed is:

1. A mast apparatus for raising and/or lowering a mast on a vessel comprising:

a mast housing comprising an upper portion, the mast housing coupled to and forming a fixed support for the mast on the vessel;

a lateral movement control mechanism comprising a pivoting collar configured to engage the mast, wherein the pivoting collar comprises a pivot about which the mast may be rotated, wherein the pivot is fixed to the upper portion of the mast housing, and wherein the pivoting collar is configured to provide controllable lateral movement of the mast through the pivoting collar with respect to the pivot and the mast housing, and forward and aft with respect to the vessel;

wherein the mast housing comprises at least two substantially parallel, spaced, upwardly extending walls extending forwardly with respect to the vessel;

wherein the lateral movement control mechanism further comprises at least one guideway mounted between the substantially parallel, spaced, upwardly extending walls of the mast housing;

wherein the guideway comprises at least one upwardly and forwardly curving guiderail;

wherein at least one guiderail supports a lower portion of the mast and is configured to guide lateral and rotational movement of the lower portion of the mast along a direction forward and aft with respect to the vessel; and a drive member connectable to the mast and connected to the mast housing, or connectable to the mast and connectable to a vessel, wherein the drive member is configured to drive the mast to rotate about the pivot and to move laterally with respect to the pivot and the mast housing through the pivoting collar, forward and aft with respect to the vessel, under the control of the lateral movement control mechanism so as to raise or lower the mast in a controlled manner.

2. A mast apparatus according to claim 1, further comprising the mast.

3. A mast apparatus according to claim 1, wherein the drive member comprises one or more of a ram, a hydraulic ram, a hydraulic multistage telescopic ram, a pushrod, a rope, a wire rope, or a winch.

4. A mast apparatus according to claim 1, wherein the pivot is an offset pivot offset from a centreline of a longitudinal axis of the mast or offset from a centreline of a longitudinal axis of an intended position for the mast.

5. A mast apparatus according to claim 1, wherein the pivoting collar comprises an inner bearing having an inner bearing surface configured to allow lateral movement of the mast through the pivoting collar.

6. A mast apparatus according to claim 1, wherein the pivoting collar comprises two opposing spigots forming the pivot.

7. A mast apparatus according to claim 1, wherein the pivoting collar comprises an outer collar supporting the mast and the outer collar surrounds an inner bearing having an inner bearing surface configured to allow lateral movement of the mast through to the pivoting collar.

8. A mast apparatus according to claim 1, wherein the pivoting collar comprises a pivoting through-bore forming the pivot and/or a pivot pin forming the pivot.

9. A mast apparatus according to claim 1, wherein the pivoting collar comprises a plate extending in one or more directions.

10. A mast apparatus according to claim 9, wherein the pivoting collar comprises an outer collar configured to support the mast and the plate substantially surrounds the outer collar.

11. A mast apparatus according to claim 1, wherein the pivoting collar comprises an offset pivot offset from a centreline of a longitudinal axis of the mast or offset from a centreline of a longitudinal axis of an intended position for the mast.

12. A mast apparatus according to claim 1, wherein the pivoting collar comprises an offset pivoting through-bore forming the pivot, and/or an offset pivot pin forming the pivot, wherein the pivot is offset from a centreline of a longitudinal axis of the mast or offset from a centreline of a longitudinal axis of an intended position for the mast.

13. A mast apparatus according to claim 1, wherein one or more guideways are elliptical or parabolic in shape to guide elliptical or parabolic movement of the mast.

14. A mast apparatus according to claim 1, wherein the at least one guideway comprises co-operating upper and lower guideways configured to engage a guide wheel on the mast.

15. A mast apparatus according to claim 14, wherein the resilient member comprises at least one of: a spring under compression, a spring under extension, an elastomeric member under compression, an elastomeric member under extension, and a resilient member comprising hydraulic oil or air or vacuum.

16. A mast apparatus according to claim 1, wherein the lateral movement control mechanism further comprises a resilient member.

17. A mast apparatus according to claim 1, wherein the drive member is arranged to push a lower portion of a mast, or a mast heel away to lower the mast during rotation of the mast about the pivot.

18. A mast apparatus according to claim 1, further comprising a vessel and the lateral movement of the mast, the mast length and the vessel length are selected so that the mast lies within the length of the vessel when in a lowered and/or stowed position.

19. A vessel comprising the mast apparatus according to claim 1.

20. A mast apparatus according to claim 1, wherein the pivot is selected from the group consisting of one or more of: at least one pin, a pivoting through-bore, and a spigot.

21. A method of raising and/or lowering a mast comprising:

providing an apparatus according to claim 1; and driving the drive member to rotate the mast about the pivot and to move the mast laterally under the control of the lateral movement control mechanism so as to raise or lower the mast in a controlled manner.

22. A mast apparatus configured to raise and/or lower a mast, comprising:

a mast housing having an upper portion, the mast housing forming a fixed support for the mast on the vessel;

a movement control mechanism comprising a pivoting collar configured to engage the mast, wherein the pivoting collar comprises a pivot about which the mast may be rotated, wherein the pivot is fixed to the upper portion of the mast housing, and wherein the pivoting collar is configured to provide controllable movement of the mast through the pivoting collar with respect to the pivot and the mast housing, and forward and aft with respect to the vessel;

wherein the mast housing comprises at least two substantially parallel, spaced, upwardly extending walls extending forwardly with respect to the vessel;

wherein the movement control mechanism further comprises at least one guideway mounted between the substantially parallel, spaced, upwardly extending walls of the mast housing;

wherein the guideway comprises at least one upwardly and forwardly curving guiderail;

wherein at least one guiderail supports a lower portion of the mast and is configured to guide movement of the lower portion of the mast along a direction forward and aft with respect to the vessel; and a drive member connectable to the mast and connected to the mast housing, or connectable to the mast and connectable to a vessel, wherein the drive member is configured to drive the mast to rotate about the pivot and configured to drive the mast to move with respect to the pivot and the mast housing through the pivoting collar, forward and aft with respect to the vessel, under the control of the movement control mechanism so as to raise or lower the mast in a controlled manner.

23. A mast apparatus according to claim 22, wherein the pivot is selected from the group consisting of one or more of: at least one pin, a pivoting through-bore, and a spigot.

24. A mast apparatus configured to raise and/or lower a mast, comprising:

a mast housing having an upper portion, the mast housing forming a fixed support for the mast on the vessel;

a movement control mechanism comprising a pivoting collar configured to engage the mast, wherein the pivoting collar comprises a pivot about which the mast may be rotated, wherein the pivot is fixed to the upper portion of the mast housing, and wherein the pivoting collar is configured to provide controllable movement of the mast through the pivoting collar with respect to the pivot and the mast housing, and forward and aft with respect to the vessel;

wherein the movement control mechanism further comprises at least one guideway extending forwardly with respect to the vessel;

wherein the guideway comprises at least one upwardly and forwardly curving guiderail;

wherein at least one upwardly and forwardly rotating guiderail supports a lower portion of the mast and is configured to guide movement of the lower portion of the mast along a direction forward and aft with respect to the vessel; and a drive member connectable to the mast and connected to the mast housing, or connectable to the mast and connectable to a vessel, wherein the drive member is configured to drive the mast to rotate about the pivot and configured to drive the mast to move with respect to the pivot and the mast housing through the pivoting collar, forward and aft with respect to the vessel, under the control of the movement control mechanism so as to raise or lower the mast in a controlled manner.

25. A mast apparatus according to claim 24, wherein the pivot is selected from the group consisting of one or more of: at least one pin, a pivoting through-bore, and a spigot.

* * * * *